US010002597B2

(12) United States Patent
Bussigel et al.

(10) Patent No.: US 10,002,597 B2
(45) Date of Patent: Jun. 19, 2018

(54) SYSTEM FOR ELECTRONICALLY GENERATING MUSIC

(71) Applicant: Brown University, Providence, RI (US)

(72) Inventors: Peter Bussigel, Providence, RI (US); Joseph Rovan, Providence, RI (US)

(73) Assignee: Brown University, Providence, RI (US)

( * ) Notice: Subject to any disclaimer, the term of this patent is extended or adjusted under 35 U.S.C. 154(b) by 0 days. days.

(21) Appl. No.: 15/304,051

(22) PCT Filed: Apr. 14, 2015

(86) PCT No.: PCT/US2015/025636

§ 371 (c)(1),
(2) Date: Oct. 13, 2016

(87) PCT Pub. No.: WO2015/160728

PCT Pub. Date: Oct. 22, 2015

(65) Prior Publication Data

US 2017/0047054 A1 Feb. 16, 2017

Related U.S. Application Data

(60) Provisional application No. 61/979,102, filed on Apr. 14, 2014.

(51) Int. Cl.
*G10H 1/28* (2006.01)
*G10H 1/00* (2006.01)

(52) U.S. Cl.
CPC ..... *G10H 1/0025* (2013.01); *G10H 1/28* (2013.01); *G10H 2210/115* (2013.01); *G10H 2210/125* (2013.01); *G10H 2220/106* (2013.01)

(58) Field of Classification Search
CPC ... G10H 1/0025; G10H 1/28; G10H 2210/115
(Continued)

(56) References Cited

U.S. PATENT DOCUMENTS 2,445,211 A 7/1948 Drake
2,739,232 A 3/1956 Schwarz
(Continued)

OTHER PUBLICATIONS

International Search Report and Written Opinion for International Application No. PCT/US2015/025636 dated Sep. 15, 2015.
(Continued)

*Primary Examiner* — David Warren
(74) *Attorney, Agent, or Firm* — Wolf, Greenfield & Sacks, P.C.

(57) ABSTRACT

A musical instrument for electronically producing music from audio segments. The musical instrument comprises: an apparatus having a first surface; a plurality of selectable elements disposed in a substantially circular geometry on the first surface; and at least one memory storing the plurality of audio segments, each of the plurality of audio segments being associated with a respective selectable element in the plurality of selectable elements, wherein, in response to detecting selection of a subset of the plurality of selectable elements, the system is configured to generate music using audio segments in the plurality of audio segments that are associated with the selected subset of the plurality of selectable elements.

14 Claims, 13 Drawing Sheets

(58) Field of Classification Search
USPC ..... 84/609
See application file for complete search history.

(56) References Cited

U.S. PATENT DOCUMENTS

| | | | | |
|---|---|---|---|---|
| 5,736,666 | A * | 4/1998 | Goodman | G10H 1/0025 84/634 |
| 5,898,120 | A | 4/1999 | Kira | |
| 6,703,549 | B1 * | 3/2004 | Nishimoto | G10H 7/002 84/609 |
| 7,732,697 | B1 * | 6/2010 | Wieder | G10H 1/0025 84/609 |
| 7,884,274 | B1 * | 2/2011 | Wieder | G06F 17/30766 360/55 |
| 8,487,176 | B1 * | 7/2013 | Wieder | G10H 1/0025 84/615 |
| 8,656,043 | B1 * | 2/2014 | Wieder | H04L 67/306 360/55 |
| 8,666,749 | B1 | 3/2014 | Subramanya et al. | |
| 8,669,887 | B2 | 3/2014 | Ward, III | |
| 8,716,584 | B1 * | 5/2014 | Wieder | G10H 1/0033 84/609 |
| 9,715,870 | B2 * | 7/2017 | Hwang | G10H 1/0025 |
| 2002/0152877 | A1 * | 10/2002 | Kay | G10H 1/0041 84/609 |
| 2003/0084779 | A1 * | 5/2003 | Wieder | G10H 1/0041 84/609 |
| 2007/0074620 | A1 | 4/2007 | Kay | |
| 2007/0193435 | A1 * | 8/2007 | Hardesty | G10H 1/0025 84/609 |
| 2010/0018382 | A1 * | 1/2010 | Feeney | A63H 5/00 84/615 |
| 2014/0018947 | A1 * | 1/2014 | Ales | G11B 20/10 700/94 |
| 2014/0190335 | A1 * | 7/2014 | Wieder | G10H 1/0025 84/609 |
| 2014/0208924 | A1 * | 7/2014 | Aiylam | G10H 1/38 84/613 |
| 2014/0230630 | A1 * | 8/2014 | Wieder | G10H 1/0008 84/609 |
| 2014/0230631 | A1 * | 8/2014 | Wieder | G10H 1/0008 84/609 |
| 2017/0047054 | A1 * | 2/2017 | Bussigel | G10H 1/28 |
| 2017/0103740 | A1 * | 4/2017 | Hwang | G10H 1/0025 |
| 2017/0206875 | A1 * | 7/2017 | Hwang | G10H 1/0025 |
| 2017/0263227 | A1 * | 9/2017 | Silverstein | G10H 1/0025 |
| 2017/0263228 | A1 * | 9/2017 | Silverstein | G10H 1/0025 |

OTHER PUBLICATIONS

International Preliminary Report on Patentability for International Application No. PCT/US2015/025636 dated Oct. 27, 2016.

* cited by examiner

SYSTEM FOR ELECTRONICALLY GENERATING MUSIC

CROSS-REFERENCE TO RELATED APPLICATIONS

This Application is a national stage application under 35 U.S.C. § 371 of International PCT Application Serial No. PCT/US2015/025636, entitled "SYSTEM FOR ELECTRONICALLY GENERATING MUSIC," filed Apr. 14, 2015, which claims the benefit under 35 U.S.C. § 119(e) of U.S. Provisional Application Ser. No. 61/979,102, entitled "MUSICAL INSTRUMENT METHODS AND APPARATUS," filed on Apr. 14, 2014, which is herein incorporated by reference in its entirety.

BACKGROUND

Electronic musical instruments, such as synthesizers, can electronically produce music by manipulating newly generated and/or existing sounds to generate waveforms, which may be played using speakers or headphones. Such an electronic musical instrument may be controlled using various input devices such as a keyboard or a music sequencer. However, conventional electronic musical instruments are limited in their ability to allow a musician to experiment with sounds to create new musical forms in a dynamic and exploratory manner.

SUMMARY

Some embodiments are directed to a method for electronically generating music using a plurality of audio segments, the method performed by a system comprising at least one computer hardware processor, the method comprising: obtaining at least a subset of the plurality of audio segments; generating, using the at least a subset of the plurality of audio segments and a first value indicating an amount of randomization, an audio segment sequence comprising a plurality of audio segment subsequences having a first subsequence of audio segments and a second subsequence of audio segments. The generating comprises: generating the first subsequence of audio segments to include each of the at least a subset of the plurality of audio segments in a first order determined based on the first value; and generating the second subsequence of audio segments to include each of the at least a subset of the plurality of audio segments in a second order determined based on the first value; and audibly presenting the generated audio segment sequence at least in part by audibly presenting the first subsequence of audio segments and the second subsequence of audio segments.

Some embodiments are directed to a system for electronically generating music using a plurality of audio segments. The system comprises at least one computer hardware processor; and at least one non-transitory computer-readable storage medium storing processor-executable instructions that, when executed by the at least one computer hardware processor, cause the at least one computer hardware processor to perform: obtaining at least a subset of the plurality of audio segments; generating, using the at least a subset of the plurality of audio segments and a first value indicating an amount of randomization, an audio segment sequence comprising a plurality of audio segment subsequences having a first subsequence of audio segments and a second subsequence of audio segments, the generating comprising: generating the first subsequence of audio segments to include each of the at least a subset of the plurality of audio segments in a first order determined based on the first value; and generating the second subsequence of audio segments to include each of the at least a subset of the plurality of audio segments in a second order determined based on the first value; and audibly presenting the generated audio segment sequence at least in part by audibly presenting the first subsequence of audio segments and the second subsequence of audio segments.

Some embodiments are directed to at least one non-transitory computer-readable storage medium storing processor-executable instructions that, when executed by at least one computer hardware processor, cause the at least one computer hardware processor to perform a method for generating music using a plurality of audio segments. The method comprises: obtaining at least a subset of the plurality of audio segments; generating, using the at least a subset of the plurality of audio segments and a first value indicating an amount of randomization, an audio segment sequence comprising a plurality of audio segment subsequences having a first subsequence of audio segments and a second subsequence of audio segments, the generating comprising: generating the first subsequence of audio segments to include each of the at least a subset of the plurality of audio segments in a first order determined based on the first value; and generating the second subsequence of audio segments to include each of the at least a subset of the plurality of audio segments in a second order determined based on the first value; and audibly presenting the generated audio segment sequence at least in part by audibly presenting the first subsequence of audio segments and the second subsequence of audio segments.

Some embodiments are directed to a method for use in connection with a system for electronically generating music, the system comprising an apparatus configured to rotate about an axis. The method comprises using the system to generate music comprising a first plurality of audio segments; determining whether the apparatus was rotated about the axis; and when it is determined that the apparatus was rotated about the axis, using the system to generate music comprising a second plurality of audio segments different from the first plurality of audio segments.

Some embodiments are directed to a system for electronically generating music. The system comprises an apparatus configured to rotate about an axis; and at least one computer hardware processor configured to perform: generating music comprising a first plurality of audio segments; determining whether the apparatus was rotated about the axis; and when it is determined that the apparatus was rotated about the axis, using the system to generate music comprising a second plurality of audio segments different from the first plurality of audio segments.

Some embodiments are directed to at least one non-transitory computer-readable storage medium storing processor executable instructions that, when executed by at least one computer hardware processor, cause the at least one computer hardware processor to perform a method for use in connection with a system for electronically generating music, the system comprising an apparatus configured to rotate about an axis. The method comprises generating music comprising a first plurality of audio segments; determining whether the apparatus was rotated about the axis; and when it is determined that the apparatus was rotated about the axis, using the system to generate music comprising a second plurality of audio segments different from the first plurality of audio segments.

Some embodiments are directed to a system for generating music from a plurality of audio segments. The system comprises: an apparatus having a first surface; a plurality of selectable elements disposed in a substantially circular geometry on the first surface; and at least one memory storing the plurality of audio segments, each of the plurality of audio segments being associated with a respective selectable element in the plurality of selectable elements, wherein, in response to detecting selection of a subset of the plurality of selectable elements, the system is configured to generate music using audio segments in the plurality of audio segments that are associated with the selected subset of the plurality of selectable elements.

BRIEF DESCRIPTION OF DRAWINGS

Various aspects and embodiments of the application will be described with reference to the following figures. It should be appreciated that the figures are not necessarily drawn to scale.

DETAILED DESCRIPTION

Figure 1A:
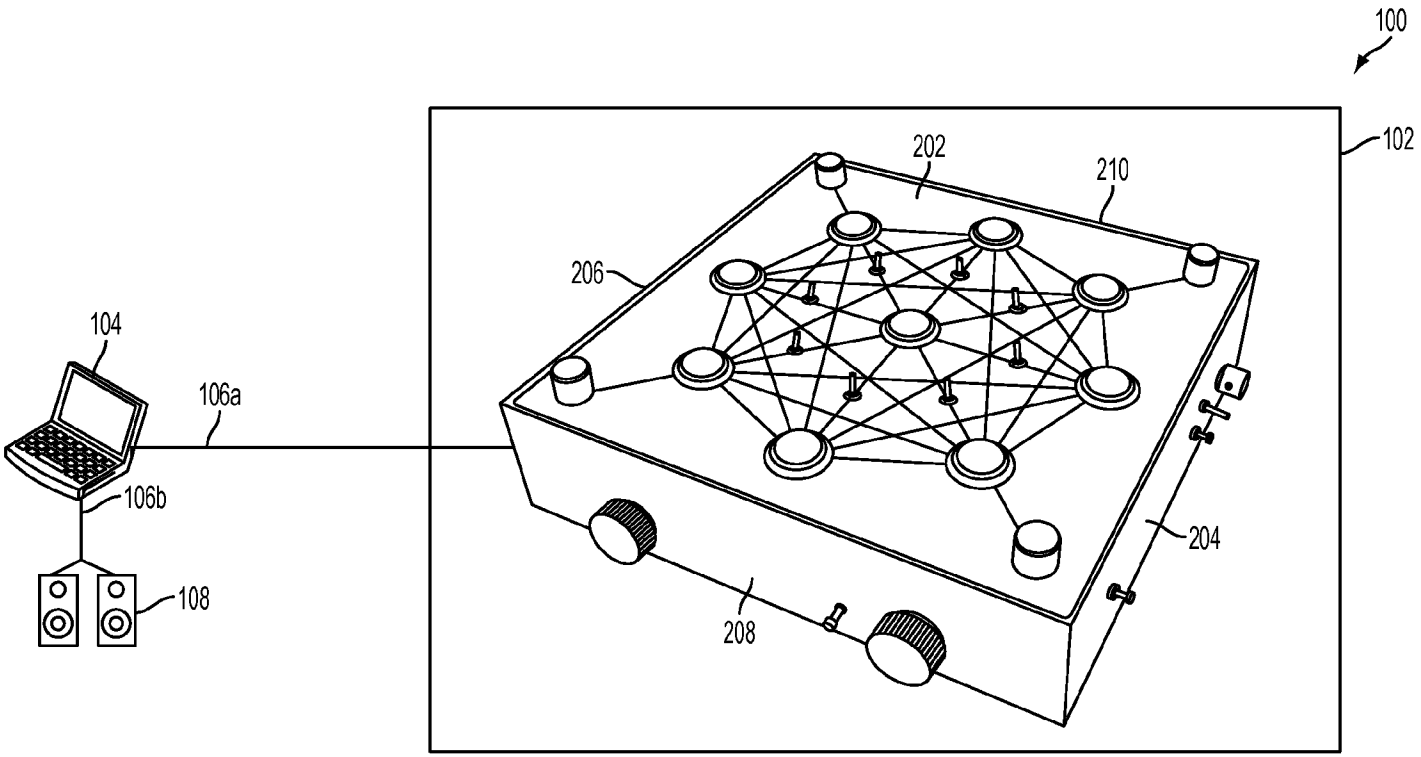
FIG. 1A shows an illustrative system for electronically generating music, in accordance with some embodiments of the technology described herein.

The inventors have created a new musical instrument that electronically generates music from a group of audio segments, each of which may correspond to a sample of an existing musical piece. The musical instrument electronically generates music by sequentially playing the audio segments in the group. Rather than playing the audio segments concurrently, like notes in a chord, the musical instrument plays the audio segments one at a time in a sequence. In this sense, the musical instrument may be said to "arpeggiate" the audio segments in the group, just like playing notes in a chord one at a time in a sequence may be referred to as playing the chord as an "arpeggio." Aspects of the inventors' insight relate to allowing a user to control the arpeggiation of a selected set of audio segments to produce music.

The inventors have appreciated that by configuring the musical instrument to give control to the user to influence how the audio segments are rendered (e.g., audibly presented) new musical forms can be generated. Composing music using techniques described herein involves playing a sequence of audio segments (e.g., samples of one or more existing music pieces or compositions) in different arrangements relative to one another. The different arrangements may be controlled by the user in a variety of ways. For example, the user may control which audio segments are played, the number of segments that are played, and/or the order in which the selected audio segments are played. As another example, the user may provide input to control one or more characteristics of the audio segments that are played, such as volume and/or pitch of the rendered audio segments, as well as the speed at which the audio segments are played. As yet another example, the user may provide input to add effects to the audio segments being played, such as reverberation. The musical instrument may comprise hardware and/or software components and the user may provide input to control the manner in which the musical instrument generates music by providing input via the hardware and/or software components, as discussed in further detail below.

In some embodiments, the order of the audio segments in the sequence of audio segments generated by the musical instrument may be randomized. The generated sequence of audio segments may comprise multiple subsequences of audio segments, each subsequence containing all the audio segments in the group of audio segments in a randomized order. Generating such a sequence of audio segments may be termed "randomized arpeggiation" of the audio segments (in contrast to "deterministic arpeggiation" of audio segments whereby the generated sequence of segments comprises multiple subsequences, each of which contains all the audio segments in the group of audio segments in the same order).

As an example of randomized arpeggiation, the musical instrument may generate music from a group of eight short audio segments (e.g., eight samples of a single recording) by sequentially playing the eight segments in one order, then sequentially playing the same eight segments in another order, then sequentially playing the same eight segments in yet another order, etc. The sequence of audio segments generated in this way may comprise multiple subsequences each having eight audio segments, and the order of the audio segments in each subsequence may be randomized. The number of audio segments that are chosen for arpeggiation may be dynamically selected by the user to provide a further dimension of control to the user in producing a musical presentation, as discussed in further detail below.

In some of the embodiments in which the order of audio segments in the sequence generated by the musical instrument is randomized, the randomization may be controlled based at least in part on user input. That is, a user may provide input that may be used to control the way in which the audio segments are randomized in the sequence of audio segments generated by the musical instrument. In some embodiments, the user may provide input (e.g., by dialing a knob on the musical instrument to a desired value or in any other suitable way) specifying an amount of randomization to impart to the sequence of audio segments. For example, if the user provides input indicating the user does not wish to randomize the audio segments (e.g., the input indicates that the amount of randomness to impart to the sequence of audio segments is 0), the musical instrument may play selected audio segments in the group of audio segments in a pre-defined order, repeatedly. On the other hand, if the user provides input specifying an amount of randomness (e.g., 60%) to be imparted to the sequence of audio segments, the music instrument generates the sequence of audio segments by selecting the next audio segment to be played at random in accordance with the specified amount of randomness (e.g., by selecting the next audio segment at random 60% of the time and selecting the next audio segment from a predefined order 40% of the time).

In some embodiments, the group of audio segments on which music composition by the musical instrument is based (or a subset of the group) may be exchanged for another group of audio segments. The musical instrument may produce music using a group of selected audio segments and, in response to user input indicating that the user desires the instrument to produce music using one or more audio segments not in the group, exchange one or more audio segments in the group for other audio segment(s). The other audio segment(s) may be obtained from a library of audio segments stored at a location accessible by the musical instrument, recorded live from the environment of the musical instrument, and/or from any other suitable source. For instance, the musical instrument may produce music using eight (or any suitable number of) audio segments corresponding to samples of an existing music composition (also referred to herein as a recording) and, in response to user input indicating that the user desires the instrument to produce music using eight other audio segments, the musical instrument may produce music using another set of eight audio segments corresponding to different samples of the same and/or different recording.

In some embodiments, the musical instrument may comprise a hardware component configured to rotate about an axis and the user may provide input indicating his/her desire for the musical instrument to generate music using a different set of audio segments by rotating the hardware component about the axis. When the musical instrument determines that the apparatus has been rotated about the axis in accordance with a pre-defined criteria (e.g., with at least a threshold speed, for at least a threshold number of degrees about the axis, and/or for at least a threshold number of revolutions about the axis, etc.), the music instrument may begin to generate music using a different group of audio segments. This "shuffle gesture" is discussed in further detail below with reference to FIGS. 3 and 4.

In some embodiments, the musical instrument includes multiple selectable elements disposed in a substantially circular geometry on a surface of the musical instrument. Each selectable element may be associated with an audio segment used by the musical instrument to generate music. In response to detecting a user's selection of one or more of the selectable elements, the musical instrument may be configured to generate music using the audio segments associated with the selected elements. For example, the musical instrument may have eight selectable elements and may be configured to generate music using eight audio segments. When none or all of the eight selectable elements are selected by a user, the musical instrument may generate music using all eight audio segments. When a subset of the eight selectable elements is selected, the musical instrument may generate music using only those audio segments (of the eight) that are associated with the selected subset of selectable elements.

In some embodiments, each of one or more of the selectable elements may function as a visual indicator configured to provide a visual indication of when an audio segment associated with the selectable element is being played. For example, a selectable element may comprise an LED (or any other component capable of emitting light) that emits light when the audio segment corresponding to the selectable element is played. However, a selectable element need not also function as a visual indicator. For example, in some embodiments, the musical instrument may have no visual indicators or ones that are distinct from the selectable elements themselves.

The musical instrument may be configured to generate music from any suitable number of audio segments of any suitable type. In some embodiments, the audio segments may be obtained by sampling audio content (e.g., one or more songs, one or more ambient sounds, one or more musical compositions, and/or any other suitable recording, etc.) to produce a plurality of audio segments. The audio content may be sampled using any suitable technique and, in some embodiments, may be sampled in accordance with the beat and/or tempo of the audio content, or may be sampled based on a desired duration for the sample.

It should be appreciated that the embodiments described herein may be implemented in any of numerous ways. Examples of specific implementations are provided below for illustrative purposes only. It should be appreciated that these embodiments and the features/capabilities provided may be used individually, all together, or in any combination of two or more, as aspects of the technology described herein are not limited in this respect.

FIG. 1A shows an illustrative system 100 for electronically generating music in accordance with some embodiments. System 100 comprises apparatus 102 coupled via connection 106*a* to computing device 104, which is coupled to audio output devices 108 via connection 106*b*. Each of connections 106*a* and 106*b* may be a wired connection, a wireless connection, or any suitable type of connection. As discussed in further detail below, apparatus 102, computing device 104, and audio output devices 108 may be separate components or integrated together. For example, in some embodiments, computing device 104 and/or audio output device 108 may be incorporated into apparatus 102.

In the embodiment illustrated in FIG. 1A, the computing device 104 stores a group of audio segments and is configured to electronically generate music from the group of audio segments based at least in part on input provided by a user via apparatus 102 and/or computing device 104. For example, computing device 104 may generate a sequence of audio segments using audio segments in the group and play the generated sequence via audio output devices 108. A user may control the music generated by computing device 104 by providing one or more inputs via apparatus 102 to alter the tempo, volume, and/or pitch with which the audio segments are played, alter the order in which the audio segments are played, control an amount of randomization in the order of the played audio segments, select the audio segments to be played, exchange one or more audio segments in the group of audio segments from which system 100 produces music for one or more other audio segments, and/or provide any other suitable input(s). In this way, the user controls the musical instrument embodied in system 100 to compose music.

Computing device 104 may comprise at least one non-transitory storage medium (e.g., memory) configured to store one or more audio segments that may be used by system 100 to generate music. Computing device 104 may store any suitable number of audio segments, as aspects of the technology described herein are not limited in this respect. In some embodiments, the computing device 104 may comprise a first non-transitory memory to store audio segments from which system 100 is configured to generate music and a second non-transitory memory different from the first non-transitory memory to store one or more other audio segments. For example, the first memory may store eight audio segments used to generate music and the second memory may store other segments that may be used to generate music if the user causes the system 100 to exchange one or more of the eight audio segments in the first memory for other segment(s). In some embodiments, the first memory may comprise a dedicated portion of memory for each of the audio segments used to generate music. For example, the first memory may comprise eight dedicated portions of memory for storing eight audio segments used to generate music.

Computing device 104 may be programmed, via software comprising processor-executable instructions stored on at least one non-transitory computer-readable storage medium accessible by computing device 104, to generate music from the group of audio segments based at least in part on user inputs provided via apparatus 102. As one example, computing device 104 may be programmed to generate a sequence of audio segments in the group and, in some embodiments, randomize the order of the audio segments in the sequence based at least in part on user input and/or one or more default settings. As yet another example, the computing device 104 may programmed to exchange the group of audio segments being used to generate music for another group of audio segments in response to user input indicating that at least one different audio segment is to be used for generating music. As yet another example, the computing device 104 may comprise software configured to perform any suitable processing of individual audio segments and/or the sequence of audio segments to achieve desired effects including, but not limited to, changing the volume and/or pitch of the audio segments played, changed the speech at which the audio segments are played, adding effects to the audio segment sequence such as reverberation and delays, applying low pass, band pass, and/or high-pass filtering, removing and/or adding artefacts such as clicks/pops, removing and/or adding jitter, and/or performing any other suitable audio signal processing technique(s).

In some embodiments, computing device 104 may be programmed, via software comprising processor-executable instructions stored on at least one non-transitory computer-readable storage medium accessible by the computing device 104, to sample (e.g., obtain a portion of, segment, etc.) one or more recordings to obtain audio segments used for generating music. The music samples acquired may be of any duration to obtain audio segments of a desired length (e.g., a fraction of a second, a second, multiple seconds, etc.). Computing device 104 may be programmed to sample the recording(s) automatically (e.g., using any suitable sampling technique such as techniques based on beat tracking or any other suitable technique) or semi-automatically (e.g., whereby sampling of the recording(s) is performed based at least in part user input). In some instances, computing device 104 may be programmed to allow a user to manually sample one or more recordings to obtain audio segments to be used for producing music.

In the illustrated embodiment, computing device 104 is a laptop computer, but aspects of the technology described herein are not limited in this respect, as computing device 104 may be any suitable computing device or devices configured to generate music from a group of audio segments based at least in part on user input. For example, in some embodiments, computing device 104 may be a portable device such as a mobile smart phone, a personal digital assistant (PDA), a tablet computer, or any other portable device configured to generate music from a group of audio segments based at least in part on user input. Alternatively, computing device 104 may be a fixed electronic device such as a desktop computer, a server, a rack-mounted computer, or any other suitable fixed electronic device configured to generate music from a group of audio segments based at least in part on user input. In some embodiments, computing device 104 includes one or more computers integrated or disposed within apparatus 102 (e.g., apparatus 102 may house computing device 104).

Audio content generated by computing device 104 (e.g., one or more sequences of audio segments or any other suitable audio waveforms) may be audibly rendered by using audio output devices onboard computing device 104 (e.g., built in speakers not shown in FIG. 1A) and/or audio output devices 108 coupled to computing device 104 via connection 106*b*. Audio output devices 108 may be any suitable device configured to audibly render audio content and, for example, may comprise one or more speakers of any suitable type.

Apparatus 102 generally includes an interface by which a user provides input to control music being produced by system 100 and comprises input devices that allow a user to do so. Apparatus 102 may comprise any suitable number of input devices of any suitable type including, but not limited to, dials, toggles, selectable elements such as buttons, switches, etc. Examples of such input devices and their functions are described in more detail below with reference to FIGS. 2A-2E.

Figure 3:
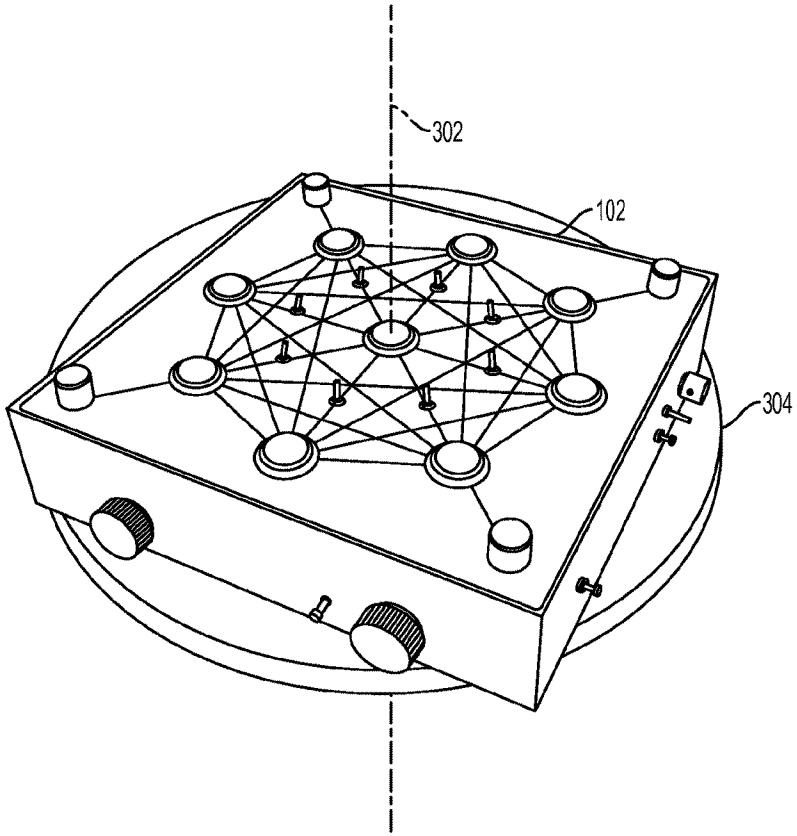
FIG. 3 is a diagram illustrating how an apparatus used for electronically generating music may be rotated about an axis to perform a shuffle gesture, in accordance with some embodiments of the technology described herein.

In some embodiments, apparatus 102 may be configured to rotate about an axis. For example, as shown in FIG. 3, apparatus 102 may be configured to rotate about a vertical axis 302 extending through a center of the top surface of apparatus 102. This may be done in any suitable way. For example, as shown in FIG. 3, apparatus 102 may comprise a circular rail 304 and be configured to rotate about circular rail 304 in response to a user action (e.g., in a response to a user physically rotating the apparatus about the circular rail). Apparatus 102 may be configured to rotate about axis 302 clockwise, counterclockwise, or both clockwise and counterclockwise. The ability to rotate apparatus 102 allows a user to perform a shuffle gesture to, for example, exchange one or more audio segments available to the user via apparatus 102 for playback in an active music composition.

In the embodiment illustrated in FIG. 1A, computing device 104 is configured to produce, based at least in part on user input provided via apparatus 102, music using audio segments accessible by the computing device 104. In other embodiments, however, at least some or all of the functionality performed by computing device 104 in order to generate music may be performed by apparatus 102. As one example, apparatus 102 may store one or more audio segments for composing music and may be configured to produce music from the audio segments by generating a sequence of the audio segments based, at least in part, on input provided via the input interface of apparatus 102. For instance, apparatus 102 may be configured to perform deterministic and/or randomized arpeggiation of the audio segments (e.g., randomized arpeggiation may be performed in response to user input specifying an amount of randomization to be used in arpeggiating the audio segments). As another example, apparatus 102 may be configured to perform any one, some, or all of the signal processing functions described above as being performed by computing device 104 (e.g., filtering, adding effects such as reverberation, etc.). As yet another example, all of the functionality performed by computing device 104 may be performed by apparatus 102, such that apparatus 102 may itself constitute a musical instrument for electronically generating music and may be configured to audibly render the generated music using one or more onboard audio output devices and/or one or more external audio output devices (e.g., audio components 108).

Conversely, in some embodiments, at least some or all of the functionality performed by apparatus 102 may be performed by computing device 104. For example, a user may provide input to control the music generated by system 100 via an interface (e.g., hardware or software) of computing device 104. For instance, computing device 104 may present a user with a graphical user interface via which a user may provide input to control the manner in which computing device 104 generate music.

Figure 1B:
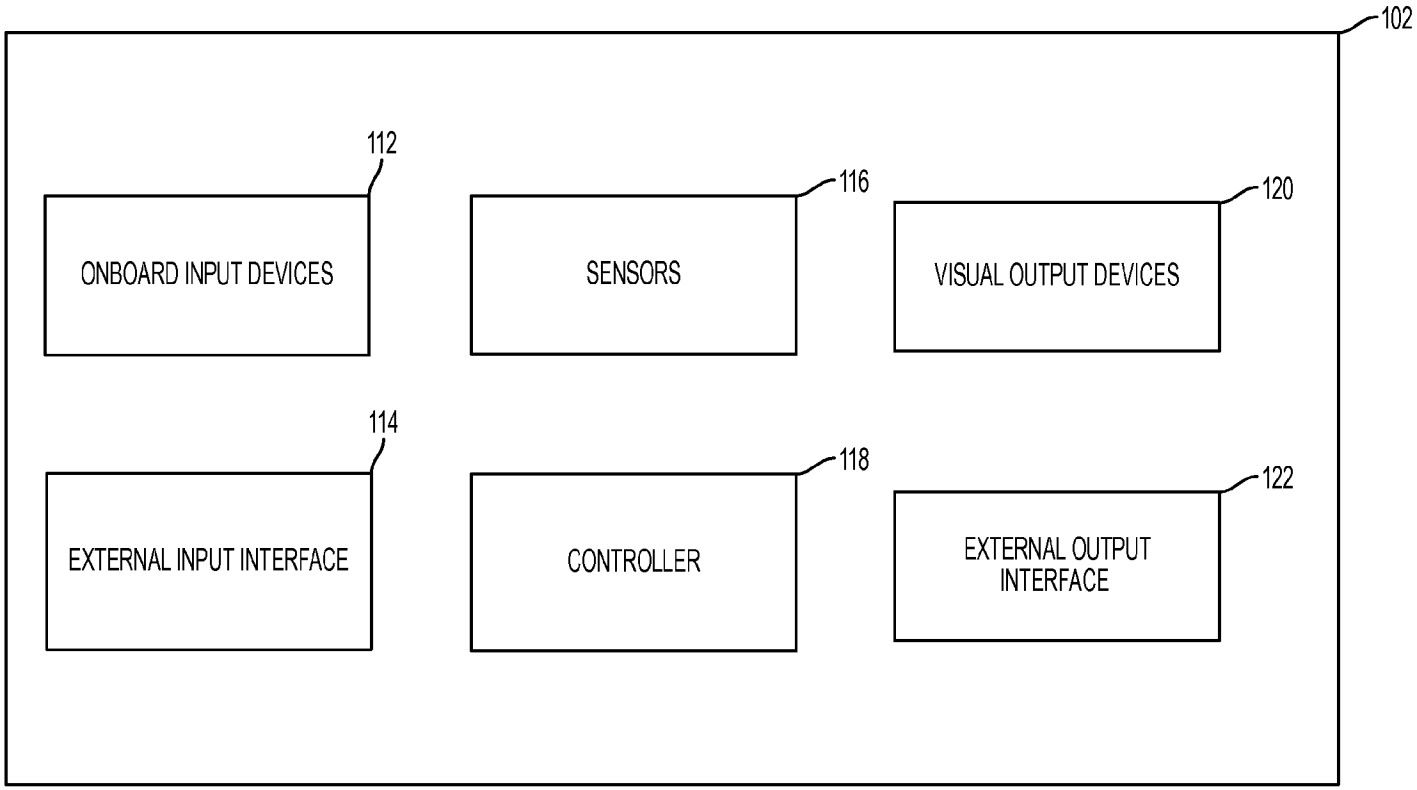
FIG. 1B is a block diagram illustrating components of a system used for electronically generating music, in accordance with some embodiments of the technology described herein.

Aspects of apparatus 102 may further be understood with reference to FIG. 1B, which is a block diagram illustrating components of apparatus 102, in accordance with some embodiments. As shown in FIG. 1B, apparatus 102 comprises onboard input devices 112, external input interface 114, sensors 116, controller 118, visual output devices 120, and external output interface 122. It should be appreciated, however, that some in some embodiments apparatus may comprise one or more other components in addition to (or instead of) the components illustrated in FIG. 1B.

Onboard input devices 112 comprise one or more devices that a user may use to provide input for controlling the way in which system 100 generates music. Examples of an onboard input device include, but are not limited to, a button, a switch (e.g., a toggle switch), a dial, and a slider. A user may use onboard input devices 112 to control any of numerous aspects of the way in which system 100 generates music. For example, the user may use onboard input devices 112 to control which audio segments are being used to generate music and/or the order in which the audio segments are played. As another example, the user may use onboard devices 112 to control the volume and/or speed at which audio segments are played by system 100. As another example, the user may be use onboard devices 112 to control pitch of the audio segments played by system 100. As yet another example, the user may use onboard input devices 112 to add effects, such as reverberation, to the audio segments being played.

Input interface 114 is configured to allow one or more other devices, not integrated with apparatus 102, to be coupled to apparatus 102 and provide, to apparatus 102, input for controlling the way in which system 100 generates music. For example, as discussed further below, external input interface 114 may allow an external clock to be coupled to apparatus 102. In turn, input from the external clock may be used to set the tempo in accordance with which system 100 generates music. Similarly, output interface 122 is configured to allow apparatus 102 to be coupled to one or more other components of system 100. For example, apparatus 102 may be coupled to computing device 104 via external output interface 122. In this way, information representing input provided by a user via onboard input devices 112 and/or information received via external input interface 114 may be transmitted to computing device 104, which in turn may generate music based on the received information.

Sensors 116 may comprise one or multiple sensors configured to obtain information about rotational motion of apparatus 102. For example, sensors 116 may comprise one or more gyroscopes, one or more accelerometers, and/or any other suitable sensor(s) configured to obtain information about rotational or inertial motion of apparatus 102. Information about rotational motion of apparatus 102 may comprise information indicating whether apparatus 102 has been rotated by at least a threshold amount (e.g., a threshold number of degrees, a threshold number of revolutions, etc.), information indicating angular momentum of apparatus 102, information indicating angular velocity of apparatus 102, etc. As described herein, information about rotational motion of apparatus 102 may be used to determine whether the user has performed a gesture indicate that the system should perform a corresponding operation (e.g., whether system 100 is to generate music using a different group of audio segments). In this way, a user may rotate the apparatus 102 to indicate a desire to compose music using a different set of music samples.

To coordinate activities involved in producing music, controller 118 may be configured to receive signals from onboard input devices 112 and/or external input interface 114 and encode the information contained therein into one or more signals to provide to computing device 104 via external output interface 122. Controller 118 may be any suitable type of controller and may be implemented using hardware, software, or any suitable combination of hardware and software.

Visual output devices 120 may comprise one or more devices configured to provide visual output. For example, visual output devices 120 may comprise one or more devices configured to emit light, for example, one or more light emitting diodes (LEDs). In some embodiments, visual output devices 120 may comprise a visual output device for each audio segment being used to generate music such that a visual output device provides a visual indication of when the associated audio segment is being played (e.g., by emitting light). As one example, system 100 may be configured to generate music using a group of eight audio segments and apparatus 102 may comprise eight visual output devices, each of the eight audio segments in the group being associated with a respective visual output device. When a particular audio segment is audibly rendered by system 100, the associated visual output device may emit light.

Figure 2A:
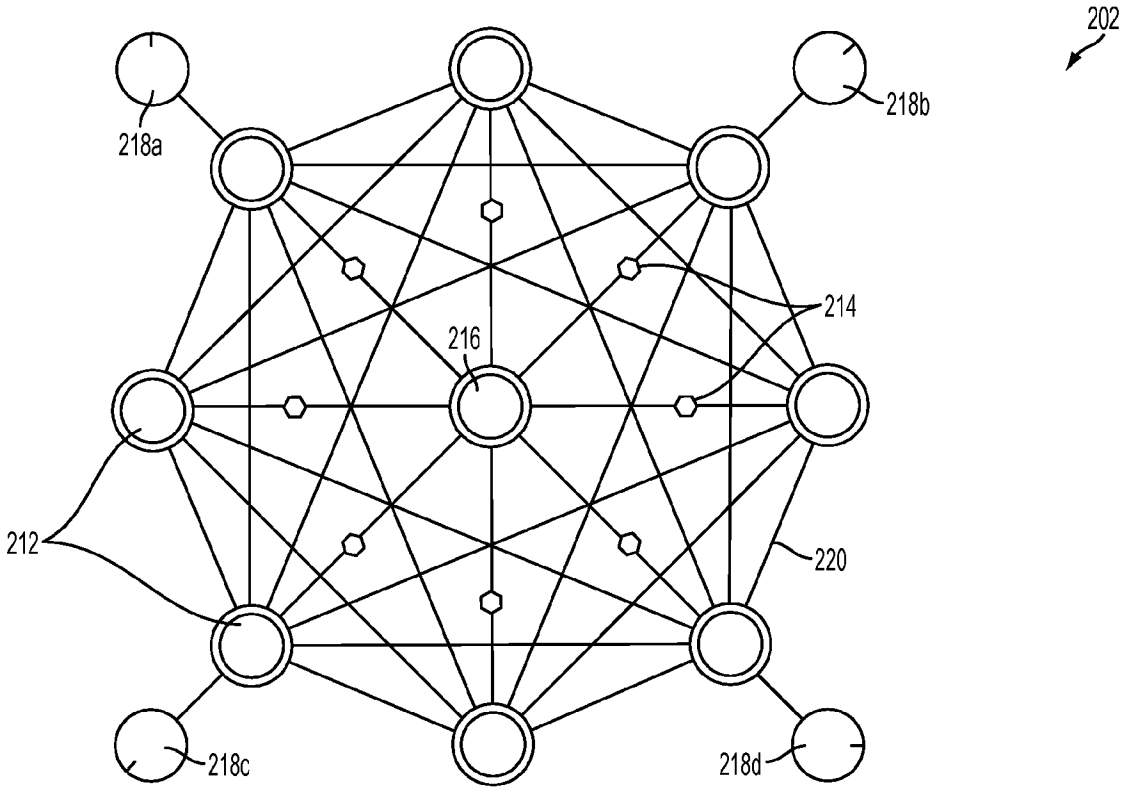
FIG. 2A is a top view of an illustrative apparatus used for electronically generating music, in accordance with some embodiments of the technology described herein.

Aspects of apparatus 102 may further be understood with reference to FIGS. 2A-2E, which show views of the top and side surfaces of apparatus 102. FIG. 2A is a view of the top surface 202 of apparatus 102. As discussed above, apparatus 102 comprises onboard input devices 112. Some of onboard input devices 112 may be disposed on a top surface of apparatus 102. For example, FIG. 2A shows various onboard input devices 112 disposed on top surface 202 including selectable elements 212, switches 214, button 216, and dials 218*a-d*. It should be appreciated that, in some embodiments, one or more other devices (e.g., onboard input devices or any other suitable type(s) of devices) may be disposed on top surface 202 in addition to or instead of the onboard input devices illustrated in FIG. 2A to perform the same or other functions, as aspects of the technology described herein are not limited in this respect.

Selectable elements 212 may be configured to allow a user to manually select the audio segments to be used for generating music. For example, each selectable element may be associated with a respective audio segment and, when a user selects one or more of the selectable elements, system 100 is configured to generate music using the audio segments associated with the selected selectable element(s). For example, when three of the selectable elements 212 are selected by a user, the three audio segments associated with the three selected elements are used to generate music (e.g., system 100 may generate music by randomly arpeggiating the three audio segments associated with the three selected elements).

One or more of selectable elements 212 may comprise a button that a user may depress to select the selectable element. However, a selectable element is not limited to comprising a button and may comprise any other suitable device that may be selected by a user (e.g., a switch). In the embodiments illustrated in FIG. 2, each of selectable elements 212 comprises a visual output device (e.g., one of visual output devices 120) configured to produce a visual indication (e.g., emit light) when associated audio segments are played. Alternatively, one or more of selectable elements 212 may not have an associated visual output device. In some embodiments, apparatus 102 may comprise visual output devices elsewhere (e.g., disposed at other locations on the top and/or other surface(s) of apparatus 102) or visual output devices may be absent altogether.

As shown in FIG. 2A, selectable elements 212 are disposed on surface 202 in a substantially circular geometry. Such geometry provides for easier manual control of apparatus 102. The substantially circular geometry provides a functional layout that facilitates operation of apparatus 102 in an intuitive and creative manner as well as providing an appealing aesthetic. Arranging selectable elements in non-circular geometries (e.g. linearly) imposes a spatial ordering that may affect play, for example, by biasing a user's preference for certain of the selectable elements, even unconsciously. By giving each selectable element the same spatial relationship to other selectable elements such tendencies may be eliminated to facilitate free form playing and avoid patterns that may result in ordered geometries or those that assign different spatial relationships to the selectable elements. However, in other embodiments, selectable elements 212 may not be disposed in a substantially circular geometry and may instead be disposed in accordance with a different geometry or design (e.g., selectable elements 212 may be disposed as an array having one or multiple rows, in a substantially rectangular geometry, etc.).

As shown in FIG. 2A, there are eight selectable elements 212 disposed on top surface 202. However, aspects of the technology described herein are not limited in this respect, as there may be any suitable number of selectable elements 212 disposed on the top (and/or any other) surface of apparatus 102 (e.g., two selectable elements, three selectable elements, four selectable elements, five selectable elements, six selectable elements, seven selectable elements, nine selectable elements, ten selectable elements, eleven selectable elements, twelve selectable elements, sixteen selectable elements selectable elements, etc.).

As shown in FIG. 2A, top surface 202 further comprises switches 214 that are arranged in a substantially circular geometry (though they may be arranged in any other suitable geometry). In the illustrated embodiment, each of switches 214 is associated with a respective selectable element 212. Each switch may be in one of two positions, termed "on" and "off" positions herein. When a switch is in an "on" position, the system 100 is configured generate music using the audio segment corresponding to the selectable element associated with the switch (along with no other audio segments, one other audio segment, or multiple other audio segments). On the other hand, when a switch is in an "off" position, the system 100 is configured to generate music without using the audio segment corresponding to the selectable element associated with a switch. It should be appreciated that, in other embodiments, the above-described functionality of switches 214 may be performed by one or more other onboard input devices or by no input devices.

As shown in FIG. 2A, button 216 is disposed on top surface 202 and is arranged at a center of the substantially circular geometry of selectable elements 212. In other embodiments, however, button 216 may be located in any other location on any surface of apparatus 102. Further, button 216 may be any other suitable input device such as a switch, for example.

In some embodiments, button 216, when pressed, allows one or more other onboard input devices to perform respective secondary functions. For example, as described in more detail below, each of dials 218*a*-218*d* may perform one function when button 216 is pressed and a different function when button 216 is not pressed. As another example, each of selectable elements 212 may perform one function when button 216 is pressed and a different function when button 216 is not pressed. For instance, when button 216 is not pressed, each of selectable elements 212 may have the above-described functionality of causing music to be generated only from those audio segments that are associated with selectable elements 212 selected by a user. On the other hand, when button 216 is pressed, each of selectable elements 212 may be used to change the audio segment associated with the selectable element to a different audio segment. For instance, when eight audio segments are associated with eight selectable elements 212, selecting a particular selectable element while button 216 is pressed may cause a ninth audio segment (e.g., not one of the eight audio segments) to become associated with the particular selectable element.

Top surface 202 further comprises dials 218*a*, 218*b*, 218*c*, and 218*d*. Each of dials 218*a*-*d* may be configured to control one or more aspects of how system 100 generates music using a group of audio segments. Each of dials 218*a*-*d* may be configured to control one aspect of how system 100 generates music using a group of audio segments and, when used in combination with another input device—when "alternative function" button 216 is pressed for example, control another aspect of how system 100 generates music using the group of audio segments. Each of dials 218*a*-*d* may, in some embodiments, be replaced with other input devices that a user can control instead of dials 218*a*-*d*, as the functionality described below as being controlled by dials 218*a*-*d* is not limited to being controlled by dials and may be controlled by any suitable types of input devices.

In the illustrated embodiment, dial 218*a* may control how many audio segments from a group of audio segments are used to generate music. For example, system 100 may be configured to generate music from a group of eight audio segments and dial 218*a* may be used to select how many of the eight (e.g., one, two, three, four, five, six, seven, or eight) of the segments are to be used in generating music. In this way, the dial 218*a* may be used to change the length of the subsequences of audio segments generated as system 100 operates to generate music. At fast tempos, manipulating dial 218*a* may create an effect of a ricochet and/or other perceptual phenomena.

In some embodiments, dial 218*a* may further be configured to perform any suitable secondary function (e.g., when button 216 is pressed) and, for example, may be configured to perform the secondary function of allowing the user to introduce reverberation and/or any other suitable effect(s)

into the music being generated by system 100 (e.g., the user may turn dial 218*a*, when button 216 is pressed to introduce reverberation and/or any other suitable effect(s)).

In the illustrated embodiment, dial 218*b* allows a user to control the way in which the audio segments used for generating music are ordered in the generated music. In particular, dial 218*b* may allow a user to control the amount of randomization imparted to the generated sequence of audio segments. A user may use dial 218*b* to input an amount of randomization to impart to the sequence of audio segments generated by system 100. As discussed above, for example, if the user provides input via dial 218*b* indicating the user does not wish to randomize the audio segments (e.g., the input indicates that the amount of randomness to impart to the sequence of audio segments is 0), system 100 may play the audio segments in the group of audio segments in a pre-defined order, repeatedly. On the other hand, if the user provides input vial dial 218*b* specifying an amount of randomness (e.g., 60%) to be imparted to the sequence of audio segments, the music instrument generates the sequence of audio segments by selecting the next audio segment to be played at random in accordance with the specified amount of randomness (e.g., by selecting the next audio segment at random 60% of the time and selecting the next audio segment from a predefined sequence 40% of the time).

In some embodiments, dial 218*b* may further be configured to perform any suitable secondary function (e.g., when button 216 is pressed) and, for example, may be configured to perform the secondary function of allowing the user to introduce an echo and/or any other suitable effect(s) into the music being generated by system 100 (e.g., the user may turn dial 218*b*, when button 216 is pressed to introduce echo and/or any other suitable effect(s)).

In the illustrated embodiment, dial 218*c* allows a user to control volume of the generated music. In some embodiments, dial 218*c* may further be configured to perform any suitable secondary function (e.g., when button 216 is pressed) and, for example, may be configured to change the resolution of notes played. For example, when button 216 is pressed, a user may use dial 218*c* to time-expand or compress the length of the audio segments played. For instance, divisions of 2, 4, 8, 16, & 32 translate into half notes, quarter notes, 8th notes, 16th notes and 32nd notes.

In the illustrated embodiment, dial 218*d* allows to user to control the pitch of the audio segments used to generate music. A user may increase or decrease the pitch of the audio segments by turning dial 218*d*. In response to a user's turning of dial 218*d*, computing device 104 may perform time-scale and/or pitch-scale modification of the audio segments. Dial 218*d* may further be configured to perform any suitable secondary function (e.g., when button 216 is pressed) and, for example, may be configured to apply a reverberation effect (different from the reverberation effect applied via the secondary function of dial 218*a*).

It should be appreciated that the above-described functions of the various input devices disposed on top surface 202 are illustrative and that there are many variations of the illustrated embodiment of top surface 202. For example, in some embodiments, the above-described input devices on surface 202 may have different functions. As another example, top surface 202 may comprise one or more other input devices having any of the above-described functions or any other suitable functions.

Figure 2B:
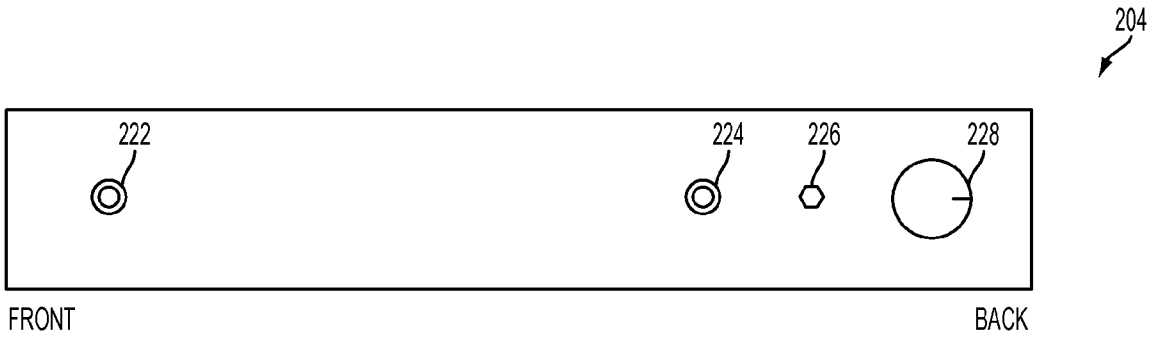
FIGS. 2B-2E are side views of an illustrative apparatus used for electronically generating music, in accordance with some embodiments of the technology described herein.

FIG. 2B shows various onboard input devices 112 disposed on side surface 204 including button 222, button 224, toggle 226, and dial 228. It should be appreciated that, in some embodiments, one or more other devices (e.g., onboard input devices or any other suitable type(s) of devices) may be disposed on side surface 204 in addition or instead of the onboard input devices 112 shown in FIG. 2B to perform the same or other functions, as aspects of the technology described herein are not limited in this respect.

In the illustrated embodiment, button 222, when pressed, allows one or more other onboard devices to perform respective secondary functions such as the secondary functions described above. Button 222 may perform the same function as button 216. In some embodiments, a user may invoke a secondary function of an onboard input device by activating the onboard input device (e.g., any onboard input device on top surface 202) and pressing either use button 216 or button 222. The user may choose to use button 216 or button 222 based on which button the user finds more convenient to press.

In the illustrated embodiment, button 224, toggle 226, and dial 228 each allow a user to control the tempo of the music generated by system 100. A user may set the tempo by pressing button 224 multiple times in accordance with a desired tempo (e.g., the user may tap the tempo out using button 224) and system 100 may generate music using a tempo obtained based on the timing of the presses of button 224. For example, system 100 may set the tempo based on an average of the intervals between a user's presses of button 224. Manually setting the tempo using button 224 may be helpful when attempting to match the beat of other music (e.g., tempo of a pre-existing recording, tempo of music being generated by another musical instrument in accordance with embodiments described herein, tempo of music being generated by another musical instrument, etc.).

In the illustrated embodiment, the tempo of music generated by system 100 may be set in accordance with an external signal such as a signal generated by an external clock. Toggle 226 may be used to control whether tempo is to be set in accordance with an external signal. For example, in some embodiments, the tempo may be set based on an external pulse (e.g., an external clock) when toggle 226 is in one position, and may be set by dial 228 when toggle 226 is in a second position different from the first position. Dial 228 may control the pulse speed of the generated sequence of audio segments. Setting the tempo of multiple musical instruments (e.g., multiple musical instruments in accordance with embodiments described herein) using the same external source (e.g., a same clock) allows these instruments to be synched and generate music together.

Figure 2C:
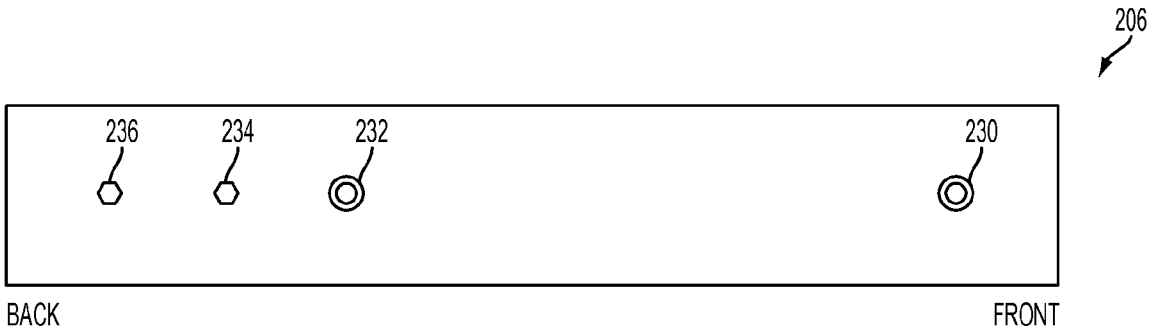

FIG. 2C shows various onboard input devices 112 disposed on side surface 206 including button 230, button 232, toggle 234, and toggle 236. It should be appreciated that, in some embodiments, one or more other devices (e.g., onboard input devices or any other suitable type(s) of devices) may be disposed on side surface 206 in addition or instead of the onboard input devices 112 shown in FIG. 2C to perform the same or other functions, as aspects of the technology described herein are not limited in this respect.

In the illustrated embodiment, button 230 allows a user to stop system 100 from playing any music. Button 230 may further clear all audio segments from the set of audio segments being used to generate music. After pressing button 230, a user may obtain a new set of audio segments to generate music by performing a shuffle gesture, for example.

In the illustrated embodiment, button 232 may be used to cause system 100 to record one or more new audio segments. When button 232 is pressed, system 100 may begin to record audio input (e.g., input obtained via a microphone)

and may stop recording the audio input when button 232 is released. The recorded input may be segmented into one or more audio segments and the obtained audio segment(s) may be used to subsequently generate music. For example, one or more audio segments recorded while button 232 is pressed may be substituted for one or more audio segments being used to generate music so that system 100 generates music at least in part by using the recorded audio segment(s).

In the illustrated embodiment, toggle 234 may be used to cause system 100 to record music that it generates. In this way, generated music may be stored and played back at a later time. The music may be recorded in any suitable way. For example, system 100 may store a copy of the music it generates. As another example, system 100 may record the music it generates by using a recording device such as a microphone. The recorded music may be stored using any suitable non-transitory computer-readable storage medium.

In some embodiments, system 100 may generate the sequence of audio segments in accordance with a beat pattern. For example, the sequence of audio segments may be generated such that beats in an audio segment are synchronized to the beat pattern. Such a mode may be termed a "pulse" mode because audio segments are synchronized to the beat pattern so that (potentially after appropriate time-scale or other processing) a beat in an audio segment or the entire audio segment may be played for each beat in the beat pattern. The beat pattern may be obtained from any suitable source and, for example, may be obtained using tempo controls such as button 224, toggle 226, and dial 228, described above. However, in other embodiments, system 100 may generate the sequence of audio segments without synchronizing the audio segments in the sequence to a beat pattern. In such a "free play" mode, a user may manually trigger playback of audio segments (e.g., by using selectable elements 212). Toggle 236 allows a user to control whether or not system 100 generates the sequence of audio in accordance with a beat pattern. For example, setting toggle 236 in a first position may cause the system to operate in "pulse" mode and generate music in accordance with a beat pattern, while setting toggle 236 in a second position different from the first position may cause the system to operate in "free" model and generate music without synchronizing audio segments to a beat pattern.

Figure 2D:
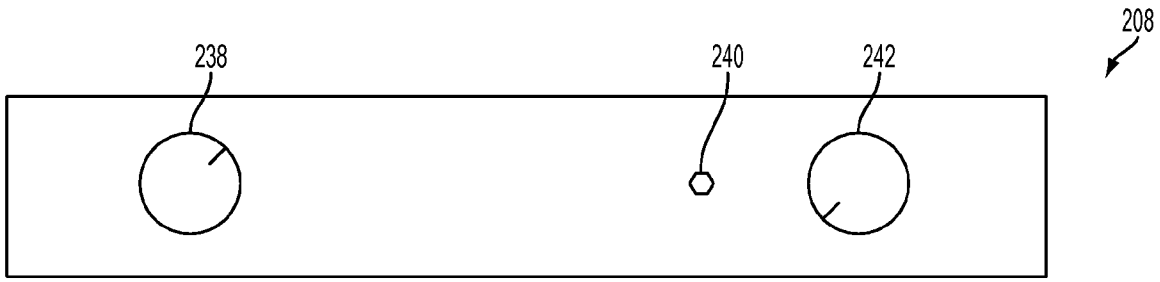

FIG. 2D shows various onboard input devices 112 disposed on side surface 208 including dial 238, toggle 240, and dial 242. It should be appreciated that, in some embodiments, one or more other devices (e.g., onboard input devices or any other suitable type(s) of devices) may be disposed on side surface 208 in addition or instead of the onboard input devices 112 shown in FIG. 2D to perform the same or other functions, as aspects of the technology described herein are not limited in this respect.

In the illustrated embodiment, dial 238 controls the volume of sound played by system 100. Toggle 240 may be used to apply high- or low-pass filtering to the generated sequence of audio segments. When toggle 240 is in a first position, system 100 may apply a high-pass filter to the generated sequence of audio segments. The cutoff frequency of the high-pass filter may be set by using dial 242. When toggle 240 is in a second position different from the first position, system 100 may apply a low-pass filter to the generated sequence of audio segments. The cutoff frequency of the low-pass filter may be set by using dial 242. The cutoff frequencies of the low- and high-pass filters may be set to default values such as 50 Hz and 50 Khz, respectively, for example. When toggle 240 is in a third ("neutral") position different from the first and second positions, neither low- nor high-pass filtering are applied to the generated sequence of audio segments.

Figure 2E:
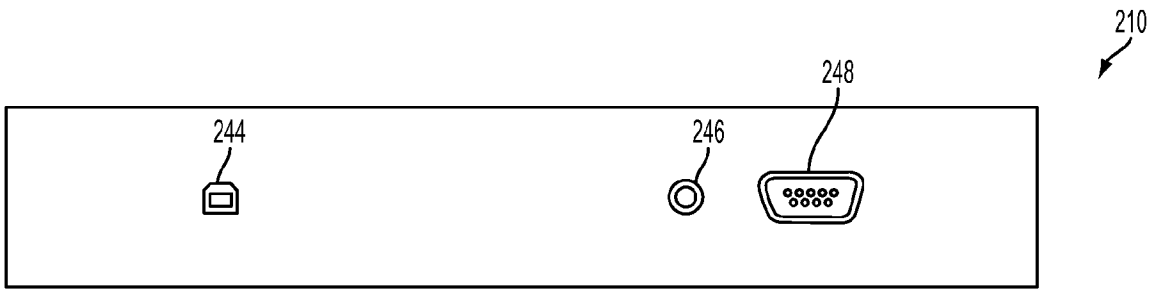

FIG. 2E shows various external input/output devices disposed on side surface 210 including ports 244, 246, and 248. It should be appreciated that, in some embodiments, one or more other devices may be disposed on side surface 210 in addition or instead of the external input/output devices shown in FIG. 2E to perform the same or other functions, as aspects of the technology described herein are not limited in this respect.

In the illustrated embodiment, port 244 is an input/output port configured to allow apparatus 102 to be coupled to computing device 104. For example, port 244 may be a USB port. However, port 244 is not limited to being a USB port and may be any suitable type of interface as apparatus 102 may be communicatively coupled to computing device 104 in any suitable way. Port 246 is configured to allow apparatus 102 to receive external signals (e.g., signal from an external clock) to which system 100 may set the tempo of the generated music, as discussed above in connection with FIG. 2B. Port 248 is configured to allow apparatus 102 to be coupled to one or more external mechanical and/or electrical systems (e.g., one or more lighting systems, one or more analog synthesizers, one or more motors, one or more microphones, etc.), which may generate output based in part on signals provided by system 100. In this way, system 100 may generate music and cause one or more external systems to simultaneously generate output corresponding to the music. For example, system 100 may generate music and send signals via port 248 to a lighting system to cause the lighting system to provide a visual display corresponding to (e.g., synchronized with) the music generated.

As discussed above, in some embodiments, a system for generating music (e.g., system 100) may allow a user to provide input indicating his/her desire for the system to generate music using a different set of audio segments. To this end, system 100 may comprise an apparatus (e.g., apparatus 102) configured to rotate about an axis (e.g., axis 302) so that the user may rotate the apparatus to indicate his/her desire for the system to generate music using a different set of audio segments. When the system determines that the apparatus has been rotated about the axis in accordance within one or more pre-defined criteria, the system may select a different set of audio segments to generate music. This action, referred to as a "shuffle gesture," may be used to exchange one or more of the audio segments. For example, in response to the shuffle gesture, the system may exchange the audio segment associated with each element 212 that is selected, or may exchange all of the audio segments. The criteria used to determine whether a shuffle gesture has been made can include any one or combination of values associated with or derived from data obtained by an accelerometer, a gyroscope, and/or any other suitable sensor.

Figure 4:
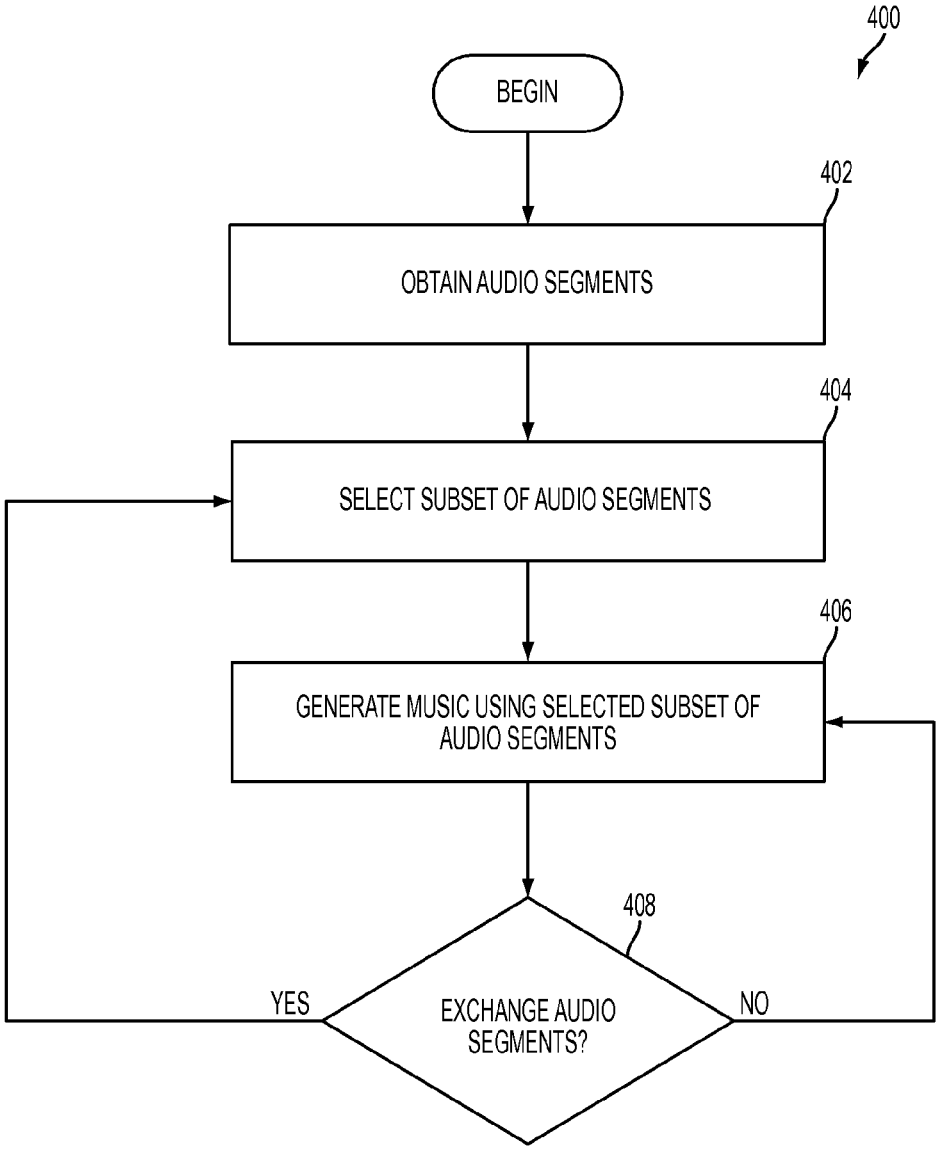
FIG. 4 is a flow chart of an illustrative process for generating music at least in part by using a shuffle gesture, in accordance with some embodiments of the technology described herein.

FIG. 4 is a flow chart of an illustrative process 400 for generating music at least in part by using the shuffle gesture. Process 400 may be performed by any suitable system that allows a user to perform a shuffle gesture and, for example, may be performed by system 100 described herein.

Process 400 begins at act 402, where a set of audio segments to be used for generating music is obtained. The set of audio segments may be obtained in any suitable way and from any suitable source(s). For example, the audio segments may have been created by segmenting audio content (e.g., by sampling one or more songs, ambient sounds, musical compositions, and/or recordings of any suitable type) into a plurality of audio segments. The audio content may be segmented using any suitable segmentation technique and, in some embodiments, may be segmented in accordance with the beat and/or tempo of the audio content. The audio content may be segmented automatically (e.g., a hardware processor executing software may segment the audio content), manually (e.g., a user may manually segment the audio recording(s)), or a combination of both (e.g., a hardware processor executing software may perform the segmentation based at least in part on input provided by a user). Such audio segments may be stored and made accessible to produce music. Any suitable number of audio segments may be obtained at act 402 of process 400 and each audio segment may be of any suitable duration, as aspects of the technology described herein are not limited in these respects.

Next, in act 404, a subset of the audio segments is selected from the set of audio segments obtained at act 402 to produce music. The subset of audio segments may be selected in any suitable way. The subset of audio segments may be selected at random from the audio segments obtained at act 402, or may be selected manually by a user. For example, the set of audio segments obtained at act 402 may comprise various audio samples from a particular recording (e.g. a song) and the subset of audio segments may be selected at random or the user may indicate which audio segments to select.

In some embodiments, eight or any other suitable number of audio segments audio segments may be selected at act 404. For example, when process 400 is executed by system 100, the number of audio segments selected may be the same as the number of selectable elements 212 disposed on top surface of apparatus 102 of system 100.

Next, in act 406, the system produces music by playing back the selected audio segments in accordance with user input to the instrument. As described herein, the system may produce music by generating a sequence of the selected audio segments and playing the generated sequence. A user may provide one or more inputs, some examples of which have been provided, to influence the way in which the sequence of audio segments is generated and/or audibly presented. For example, as discussed above, the selected audio segments or a subset thereof may be arpeggiated either deterministically or randomly to a degree chose by the user.

While the system executing process 400 is generating music using the audio segments selected at act 404 in accordance with user input, process 400 proceeds to decision block 408, where it is determined whether a user has provided input indicating whether one or more of the audio segments used to generate music are to be exchanged for other audio segments. This determination may be made in any suitable way. For example, in some embodiments, system 100 may comprise an apparatus (e.g., apparatus 102) configured to rotate about an axis (e.g., axis 302) so that the user may rotate the apparatus about the axis to provide input indicating whether one or more of the audio segments used to generate music are to be exchanged for other audio segments.

When the system determines that the apparatus has been rotated in accordance with a pre-defined criteria (e.g., any criteria based on the rotational information obtained from corresponding sensors such as acceleration, angular velocity or momentum, extent of revolution, etc.), the system may deem a shuffle gesture to have been performed, and audio segments may be shuffled accordingly. Though, in other embodiments, a user may provide input indicating that one or more of the audio segments used to generate music are to be exchanged for other audio segments in any other suitable way (e.g., by pressing a button).

When it is determined, at decision block 408, that the user has indicated a desire to shuffle audio segments, process 400 returns to act 404, via the "YES" branch, and a new set of audio segments is selected from the set of audio segments obtained at act 402 (e.g., one or more audio segments are exchanged). Otherwise, process 400 returns to act 406, via the "NO" branch, and the system executing process 400 continues to produce music using the same set of audio segments in a manner instructed by the user playing the instrument, as described herein.

Figure 5A:
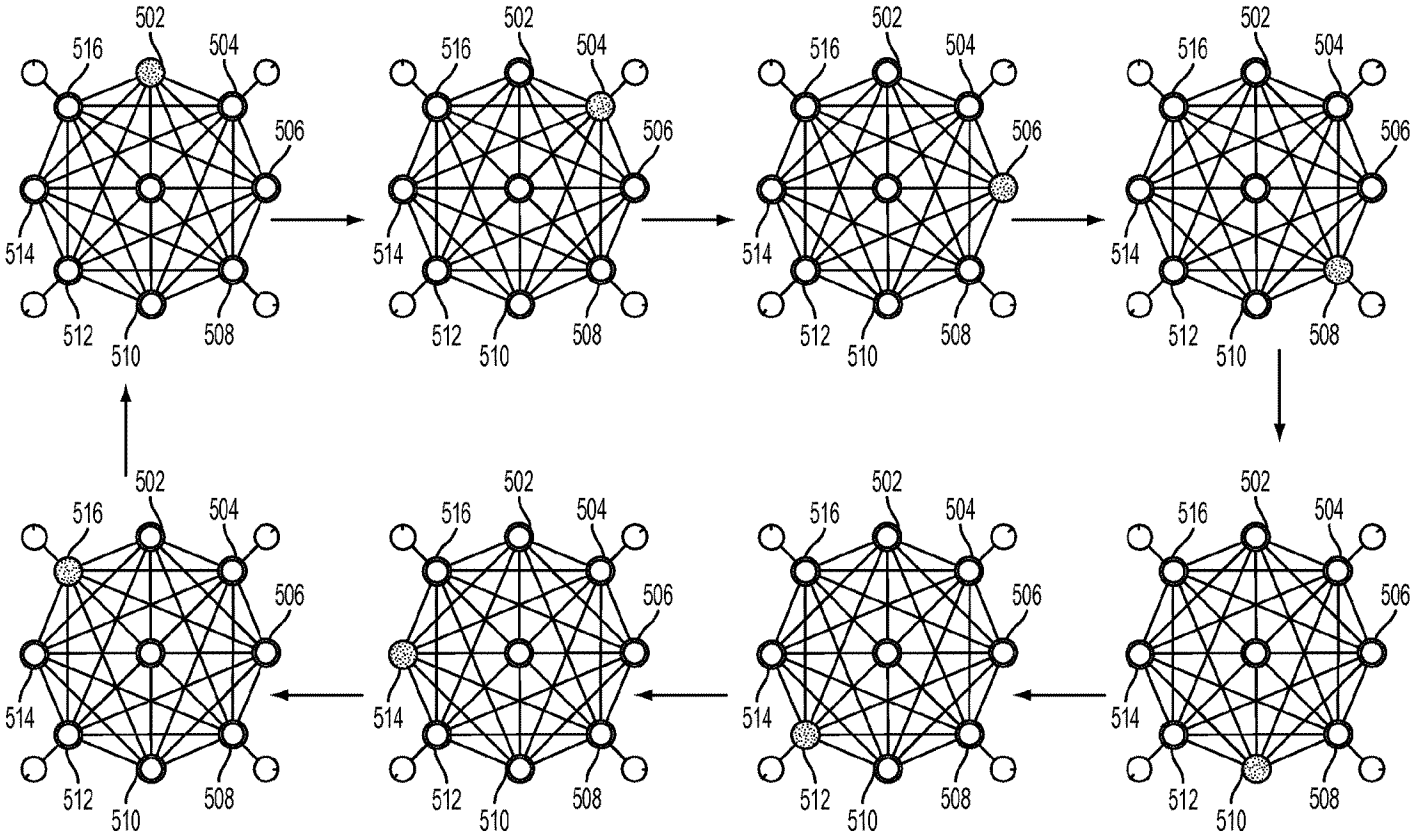
FIGS. 5A and 5B illustrate deterministic arpeggiation, in accordance with some embodiments of the technology described herein.
Figure 5B:
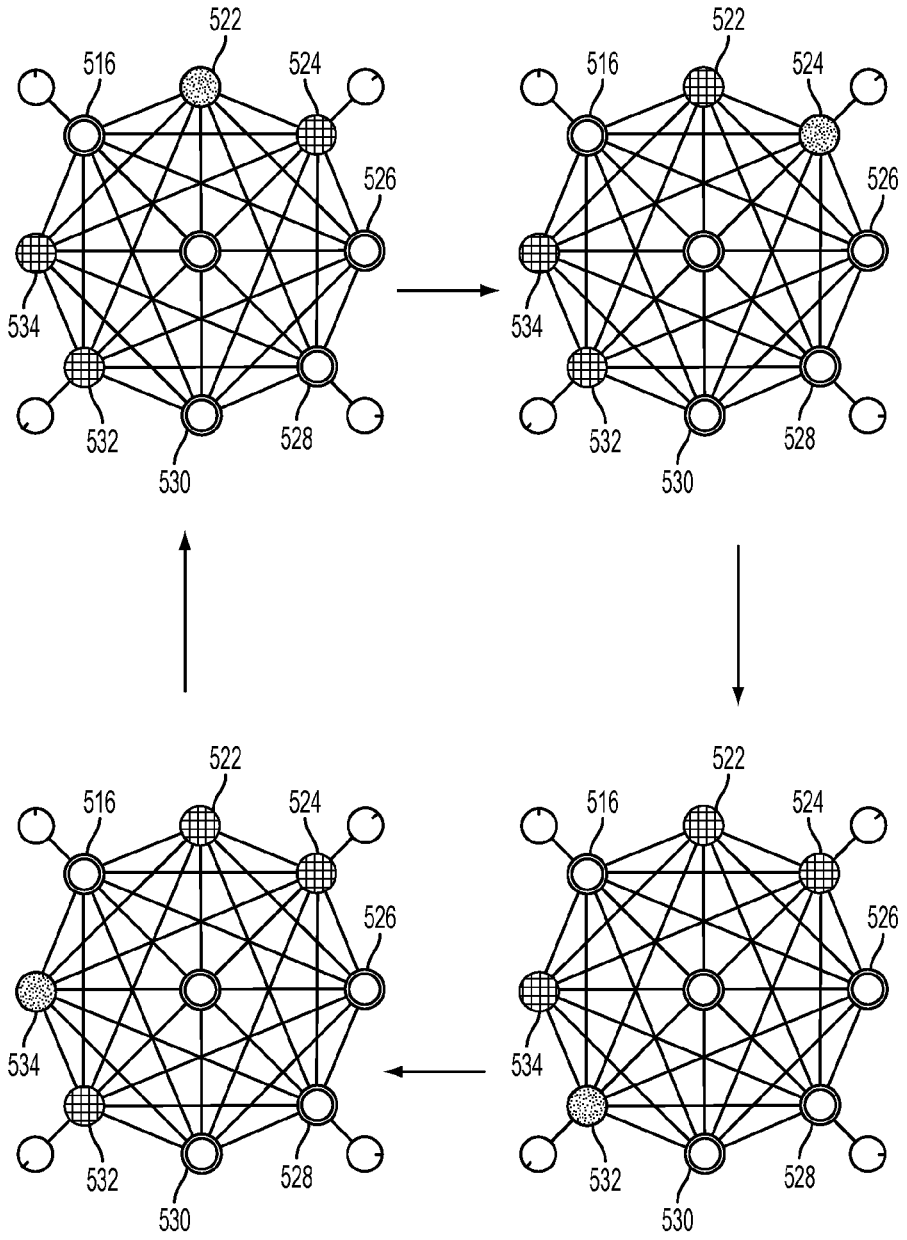
Figure 5C:
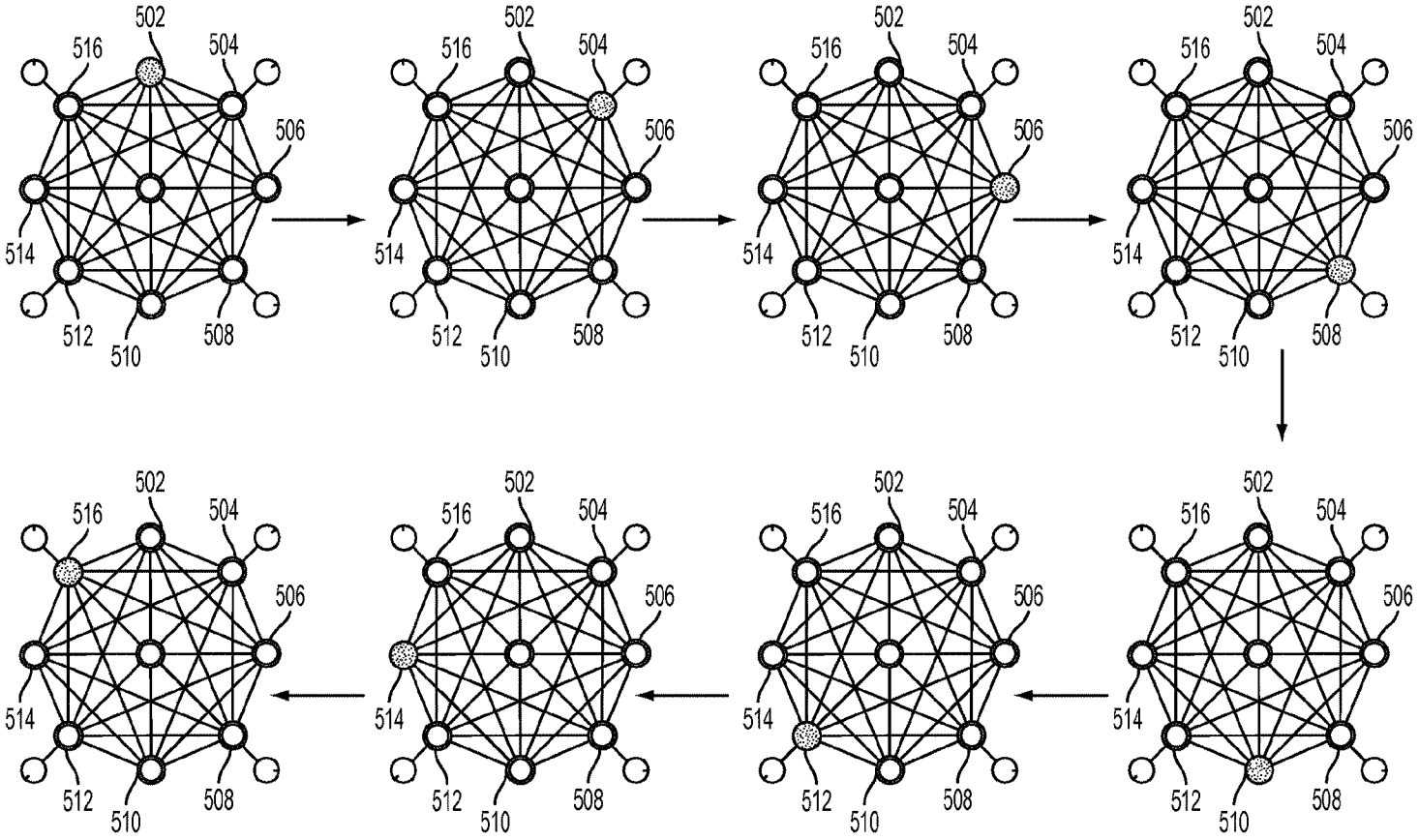
FIGS. 5C and 5D illustrate randomized arpeggiation, in accordance with some embodiments of the technology described herein.
Figure 5D:
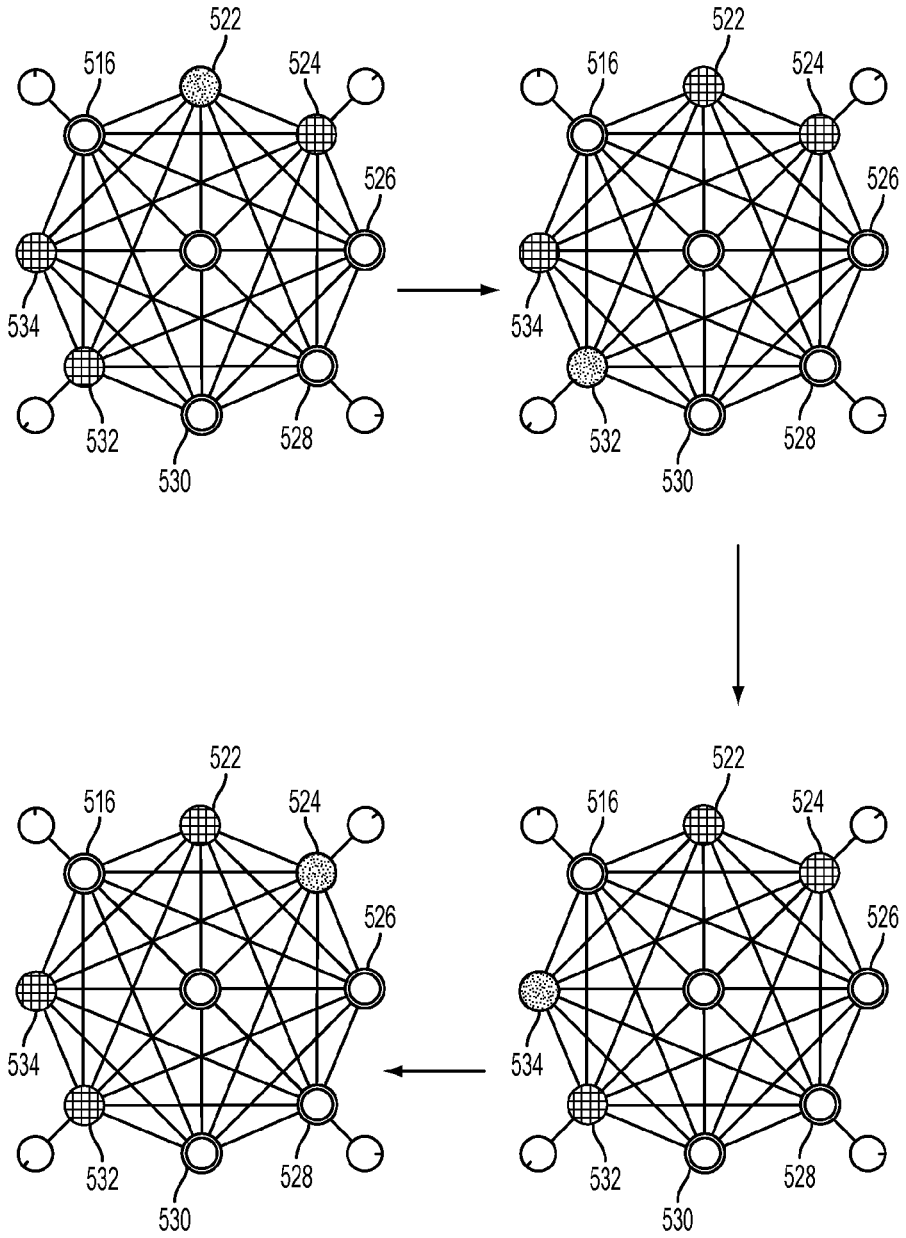

The manner in which system 100 may generate music from a set of audio segments may be further understood with reference to FIGS. 5A-5B, which illustrate deterministic arpeggiation, and FIGS. 5C-5D, which illustrate randomized arpeggiation. As discussed above, system 100 comprises apparatus 102 having selectable elements associated with respective audio segments. Each selectable element may comprise a visual indicator that emits light when the respective audio segment is played by system 100. FIGS. 5A-5D illustrate an example of how system 100 may generate music using eight audio segments by showing a sequence of views of an instrument (e.g., apparatus 102) as music is being produced. In the views of FIGS. 5A-5D, a shaded selectable element indicates that system 100 is playing the audio segment associated with the shaded selectable element, and a cross-hatched selectable element indicates that the user selected the selectable element (e.g., pressing the element when the element is a button).

FIG. 5A illustrates how system 100 produces music by deterministically arpeggiating eight audio segments. As discussed above, deterministically arpeggiating audio segments comprises repeatedly playing the audio segments in the same order. Starting from the top-left view shown in FIG. 5A, it may be seen that the audio segment associated with selectable element 502 is being played. Following the rightward arrow from the top-left view, it may be seen that the audio segment associated with selectable element 504 is played after the audio segment associated with selectable element 502 is played. Following the arrows, it may be seen that the next audio segment to be played is the audio segment associated with selectable element 506. Next, the audio segment associated with selectable element 508 is played. Next, the audio segment associated with selectable element 510 is played. Next, the audio segment associated with selectable element 512 is played. Next, the audio segment associated with selectable element 514 is played. Next, the audio segment associated with selectable element 516 is played. Next, the sequence of audio segments begins to repeat, as the audio segment associated with selectable element 502 is played. Next, the audio segment associated with selectable element 504 is played. And, so on. In this way, when system 100 generates music by deterministically arpeggiating the eight audio segments associated with selectable elements 502-516, the sequence of eight segments is played repeatedly forming a periodic sequence.

As discussed above, selectable elements of apparatus 102 may allow the user to manually select the audio segments to use for producing music. FIG. 5B illustrates how system 100 generates music by deterministically arpeggiating the audio segments that correspond to the elements selected by the user. In particular, FIG. 5B illustrates deterministic arpeggiation of the audio segments associated with selected selectable elements 522, 524, 532, and 534 (that these selectable elements are selected by the user is indicated with cross-hatching). As shown, deterministically arpeggiating the audio segments associated with elements 522, 524, 532, and 534 comprises playing the audio segment associated with element 522, then playing the audio segment associated with element 524, then playing the audio segment associated with element 532, then playing the audio segment associated with element 534, then repeating the sequence and playing the audio segment associated with element 522, then playing the audio segment associated with element 524, and so on. In this way, when system 100 generates music by deterministically arpeggiating the four audio segments associated with selectable elements 522, 524, 532, and 534, the sequence of four segments is played repeatedly forming a periodic sequence.

FIG. 5C illustrates how system 100 produces music by randomly arpeggiating eight audio segments. As discussed above, randomized arpeggiation of a set of audio segments comprises playing all the audio segments in the set in a first random order, then playing all the audio segments in the set in a second random order, then playing all the audio segments in the set in a third random order, and so on. As a result, the sequence of audio segments generated by randomized arpeggiation comprises multiple subsequences of audio segments, each subsequence containing all the audio segments in the set in a randomized order. The order of segments in one subsequence may therefore be different from the order of segments in another subsequence. Starting from the top-left view shown in FIG. 5C, it may be seen that the audio segment associated with selectable element 502 is being played. Following the rightward arrow from the top-left view, it may be seen that the audio segment associated with selectable element 512 is played after the audio segment associated with selectable element 502 is played (as opposed to the playing the audio segment associated with selectable element 504 which would have been played if the system were generating music using deterministic arpeggiation). Following the arrows, it may be seen that the next audio segment to be played is the audio segment associated with selectable element 516. Next, the audio segment associated with selectable element 508 is played. Next, the audio segment associated with selectable element 504 is played. Next, the audio segment associated with selectable element 510 is played. Next, the audio segment associated with selectable element 506 is played. Next, the audio segment associated with selectable element 514 is played. In this way, all eight audio segments are played in a first random order (i.e., the order indicated by the sequence of elements: 502, 512, 516, 508, 504, 510, 506, and 514). Next, system 100 may play each of the audio segments in a second random order (e.g., in the order indicated by the sequence of elements: 512, 516, 504, 510, 502, 508, 514, and 506). Next, system 100 may play each of the audio segments in a third random order, and so on. In this way, when system 100 generates music by randomly arpeggiating the eight audio segments associated with selectable elements 502-516, each time the set of eight audio segments is played, it is played in a randomized order.

FIG. 5D illustrates how system 100 produces music by randomly arpeggiating the audio segments that correspond to selectable elements selected by the user. In particular, FIG. 5D illustrates deterministic arpeggiation of the audio segments associated with selected selectable elements 522, 524, 532, and 534 (that these selectable elements are selected by the user is indicated with cross-hatching). As shown, after the audio segment associated with element 522 is played, the audio segment associated with element 532 is played. Next, the audio segment associated with element 534 played. Next, the element associated with element 524 is played. In this way, all four audio segments are played in a first random order (i.e., the order indicated by the sequence of elements: 522, 532, 534, and 524). Next, system 100 may play each of the audio segments in a second random order (e.g., in the order indicated by the sequence of elements: 532, 524, 534, and 522). Next, system 100 may play each of the audio segments in a third random order, and so on. In this way, when system 100 generates music by randomly arpeggiating the four audio segments associated with selectable elements 522, 524, 532, and 534, each time the set of four audio segments is played, it is played in a randomized order.

It should be appreciated that although FIGS. 5A-5D illustrate arpeggiation using four or eight audio segments, this is not a limitation of aspects of the technology described herein. In some embodiments, music may be generated by arpeggiating, randomly or deterministically, any suitable number of audio segments.

Figure 6:
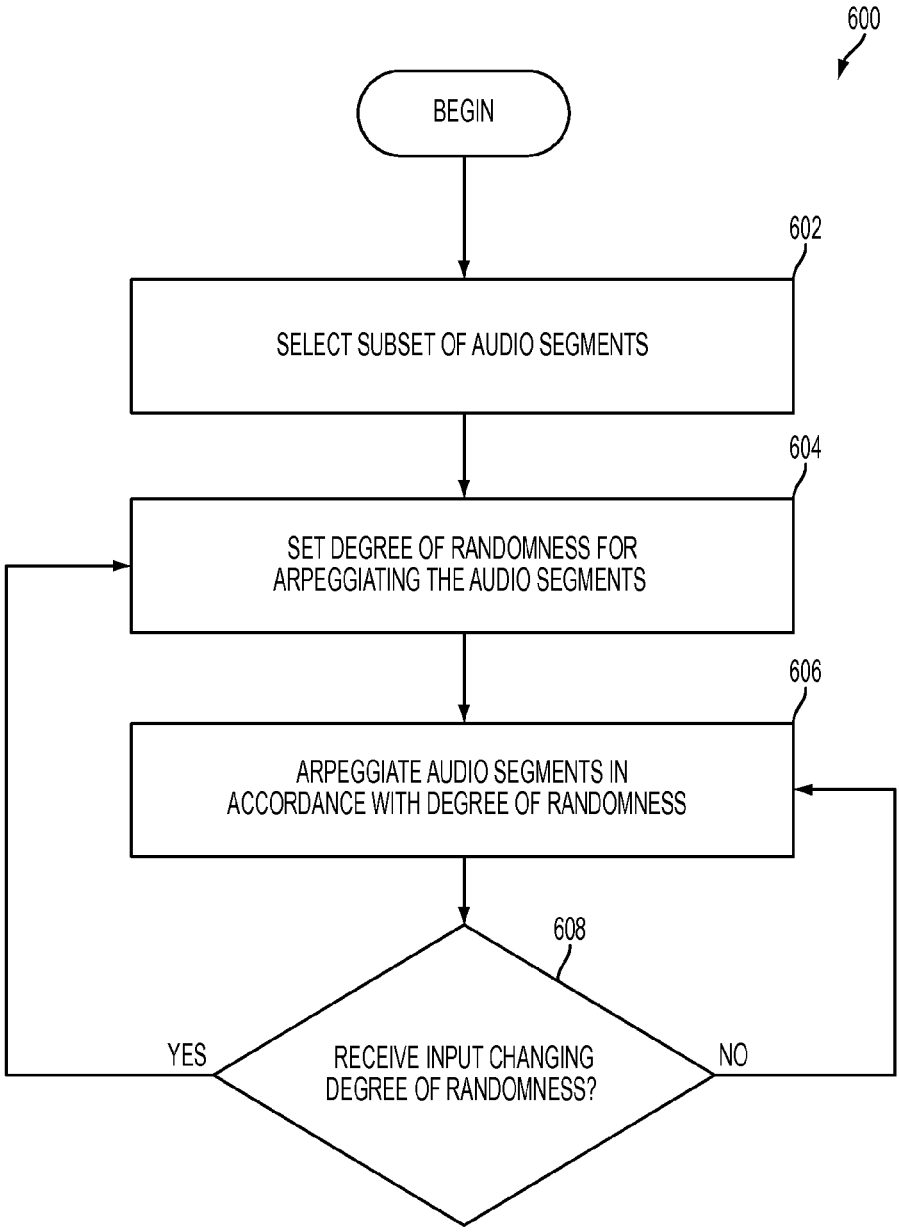
FIG. 6 is a flow chart of an illustrative process for generating music at least in part by using randomized arpeggiation, in accordance with some embodiments of the technology described herein.

FIG. 6 is a flow chart of an illustrative process 600 for producing music by randomly arpeggiation audio samples, in accordance with some embodiments of the technology described herein. Process 600 may be performed by any suitable musical instrument that is configured to produce music at least in part by randomized arpeggiation of audio samples and, for example, may be performed by system 100 described herein. The musical instrument configured to execute process 600 may be configured to produce music from a set of any suitable number (e.g., eight) of audio samples.

Process 600 begins at act 602, where a subset of the set of audio segments is selected to be used for producing music. The subset of audio segments may include one or more (e.g., all) of the set audio segments. The subset of audio segments may be selected in any suitable way and, in some embodiments, may be selected based on user input. For example, as described above, a musical instrument may include multiple selectable elements (e.g., selectable elements 212 described with respect to FIG. 2A) each associated with an audio segment. In response to a user's selection of one or more of these selectable elements, the musical instrument may be configured to produce music using the audio segments associated with the selected elements.

Next, in act 604, the degree of randomness used for randomized arpeggiation of the selected audio segments is set. Setting the degree of randomness may comprise setting a parameter to a value indicating an amount of randomness in accordance with which randomized arpeggiation of the selected audio segment is to be performed. The parameter may take on values in a range (e.g., values in the range of numbers between 0 and 1 or any other suitable range), with values at one end of the range indicating that less randomness is to be used and values at the other end of the range indicating that more randomness is to be used. For example, the value 0 may indicate that the selected audio segments are to be played in a predefined order, the value 1 may indicate that the selected audio segments are to be played in a completely random order (e.g., the next audio segment in the generated sequence of audio segments is selected random), and a value p (where $0<p<1$) may indicate that the next audio segment is to be selected at random with probability p (e.g., p % of the time) and from a pre-defined order with probability $1-p$ (e.g., the rest of the time).

In some embodiments, the degree of randomness may be set based on user input. For example, the value of a parameter indicating an amount of randomness to be used in arpeggiating the selected audio segments, may be set based on user input. For instance, the user may provide input by via an input device on the musical instrument (e.g., by dialing a knob on the musical instrument to a desired value or in any other suitable way) specifying an amount of randomization to impart to the sequence of audio segments. It should be appreciated that the degree of randomness is not limited to being set based on user input and, in some embodiments, may be set to a default value and/or automatically adjusted.

Next, in act 606, the musical instrument performing process 600 randomly arpeggiates the audio segments selected at act 602 in accordance with the degree of randomness set at act 604. This may be done in any suitable way. In some embodiments, as described above, randomized arpeggiation of audio segments may comprise generating a sequence of audio segments with each audio segment in the generated sequence being selected either at random or according to a pre-defined order. Whether a particular audio segment is selected at random or according to a pre-defined order may be determined based on the degree of randomness set at act 604. For example, when the degree of randomness is represented by a value $0 \leq p \leq 1$, an audio segment may be selected at random with probability p and according to a pre-defined order with probability 1−p. In this case, when p=0, all the audio segments are selected according to a predefined order and, when p=1, all the audio segments are chosen at random (e.g., uniformly at random with or without replacement).

Next, process 600 proceeds to decision block 608, where it is determined whether input changing the degree of randomness has been received. This determination may be made in any suitable way. For example, if a user provides input changing the degree of randomness (e.g., by turning a dial, such as dial 218*b*, to a different setting), it may be determined that input changing the degree of randomness has been received. When it is determined that the input changing the degree of randomness has been received, process 600 returns, via the YES branch, to act 604 where the degree of randomness is set in accordance with the newly received input. Otherwise, process 600 returns to act 606, where the musical instrument executing process 600 continues to produce music by randomly arpeggiating the selected audio segments in accordance with the degree of randomness set at act 604.

Figure 7:
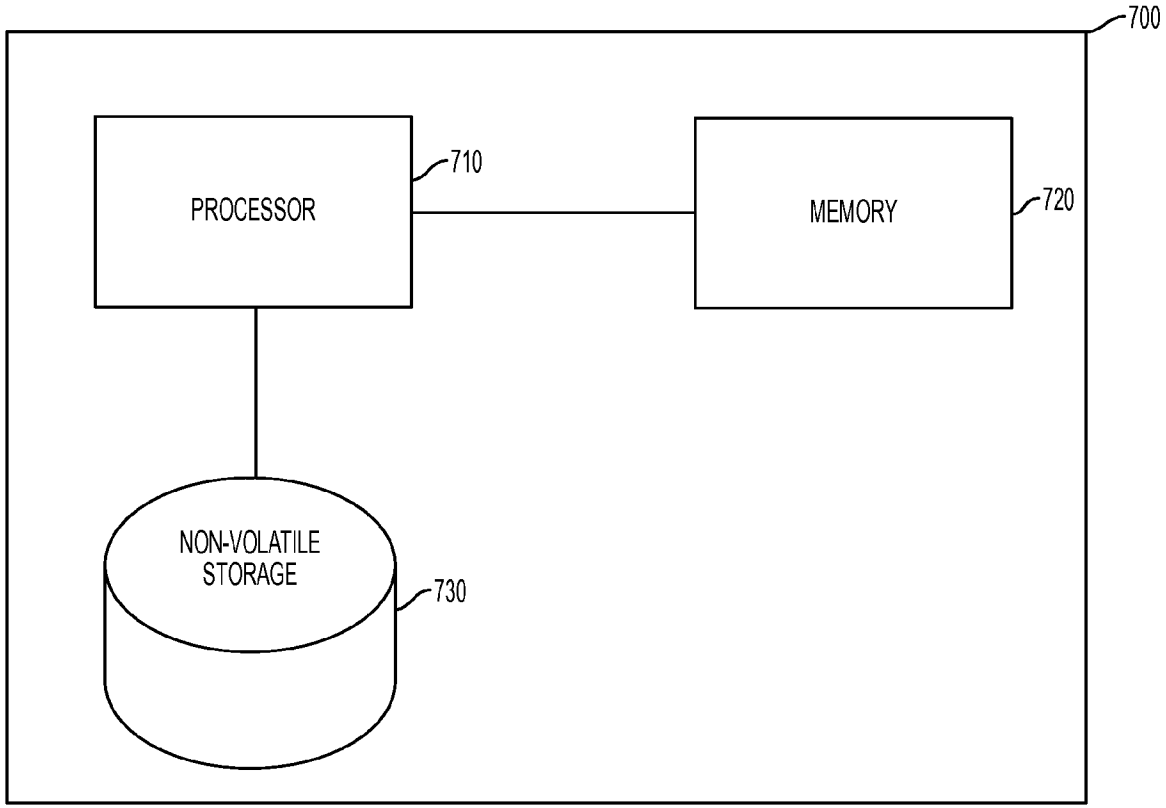
FIG. 7 is a block diagram of an illustrative computer system that may be used in implementing some embodiments.

FIG. 7 is a block diagram of an illustrative computer system that may be used in implementing some embodiments. An illustrative implementation of a computer system 700 that may be used to implement one or more of the scoring or evaluation techniques, or to perform one or more other services described herein is shown in FIG. 7. Computer system 700 may include one or more processors 710 and one or more non-transitory computer-readable storage media (e.g., memory 720 and one or more non-volatile storage media 730). The processor 710 may control writing data to and reading data from the memory 720 and the non-volatile storage device 730 in any suitable manner, as the aspects of the invention described herein are not limited in this respect.

To perform functionality and/or techniques described herein, the processor 710 may execute one or more instructions stored in one or more computer-readable storage media (e.g., the memory 720, storage media, etc.), which may serve as non-transitory computer-readable storage media storing instructions for execution by the processor 710. Computer system 700 may also include any other processor, controller or control unit needed to route data, perform computations, perform I/O functionality, etc. For example, computer system 700 may include any number and type of input functionality to receive data and/or may include any number and type of output functionality to provide data, and may include control apparatus to operate any present I/O functionality.

In connection with the scoring techniques and other evaluation and recommendation services described herein, one or more programs configured to receive information, evaluate data, determine one or more talent scores and/or provide information to employers and/or candidates may be stored on one or more computer-readable storage media of computer system 700. Processor 710 may execute any one or combination of such programs that are available to the processor by being stored locally on computer system 700 or accessible over a network. Any other software, programs or instructions described herein may also be stored and executed by computer system 700. Computer 700 may be a standalone computer, server, part of a distributed computing system, mobile device, etc., and may be connected to a network and capable of accessing resources over the network and/or communicate with one or more other computers connected to the network.

The terms "program" or "software" are used herein in a generic sense to refer to any type of computer code or set of processor-executable instructions that can be employed to program a computer or other processor to implement various aspects of embodiments as discussed above. Additionally, it should be appreciated that according to one aspect, one or more computer programs that when executed perform methods of the disclosure provided herein need not reside on a single computer or processor, but may be distributed in a modular fashion among different computers or processors to implement various aspects of the technology described herein.

Processor-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in one or more non-transitory computer-readable storage media in any suitable form. For simplicity of illustration, data structures may be shown to have fields that are related through location in the data structure. Such relationships may likewise be achieved by assigning storage for the fields with locations in a non-transitory computer-readable medium that convey relationship between the fields. However, any suitable mechanism may be used to establish relationships among information in fields of a data structure, including through the use of pointers, tags or other mechanisms that establish relationships among data elements.

Also, various inventive concepts may be embodied as one or more processes, of which examples have been provided. The acts performed as part of each process may be ordered in any suitable way. Accordingly, embodiments may be constructed in which acts are performed in an order different than illustrated, which may include performing some acts concurrently, even though shown as sequential acts in illustrative embodiments.

All definitions, as defined and used herein, should be understood to control over dictionary definitions, and/or ordinary meanings of the defined terms.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the techniques described herein in detail, various modifications, and improvements will readily occur to those skilled in the art. Such modifications and improvements are intended to be within the spirit and scope of the disclosure. Accordingly, the foregoing description is by way of example only, and is not intended as limiting. The techniques are limited only as defined by the following claims and the equivalents thereto.

What is claimed is:

1. A method for electronically generating music using a plurality of audio segments, the method performed by a system comprising at least one computer hardware processor, the method comprising:

obtaining at least a subset of the plurality of audio segments;

receiving first user input specifying a first value indicating an amount of randomization;

generating, using the at least a subset of the plurality of audio segments and the first value indicating the amount of randomization, an audio segment sequence comprising a plurality of audio segment subsequences having a first subsequence of audio segments and a second subsequence of audio segments, the generating comprising:

generating the first subsequence of audio segments to include each of the at least a subset of the plurality of audio segments in a first order determined based on the first value; and generating the second subsequence of audio segments to include each of the at least a subset of the plurality of audio segments in a second order determined based on the first value, wherein the first value specifies a probability in accordance to which an audio segment in a particular subsequence of audio segments is to be selected uniformly at random from among those audio segments in the at least a subset of the plurality of audio segments that have not yet selected to be part of the particular subsequence of audio segments; and audibly presenting the generated audio segment sequence at least in part by audibly presenting the first subsequence of audio segments and the second subsequence of audio segments.

2. The method of claim 1, wherein the system comprises an apparatus having a plurality of selectable elements, each of the plurality of audio segments being associated with a selectable element in the plurality of selectable elements, wherein the obtaining comprises:

obtaining the subset of the plurality of segments associated with selectable elements selected by a user.

3. A method for electronically generating music using a plurality of audio segments, the method performed by a system comprising at least one computer hardware processor, the method comprising:

obtaining at least a subset of the plurality of audio segments;

receiving first user input specifying a first value indicating an amount of randomization;

receiving second user input specifying a second value indicating a second amount of randomization, different from the first amount of randomization, to be employed in generating music using the at least a subset of the plurality of audio segments;

generating, using the at least a subset of the plurality of audio segments and the first value indicating the amount of randomization, an audio segment sequence comprising a plurality of audio segment subsequences having a first subsequence of audio segments and a second subsequence of audio segments, the generating comprising:

generating the first subsequence of audio segments to include each of the at least a subset of the plurality of audio segments in a first order determined based on the first value;

generating the second subsequence of audio segments to include each of the at least a subset of the plurality of audio segments in a second order determined based on the first value; and generating, using the at least a subset of the plurality of audio segments and the second value, an audio segment sequence comprising a plurality of audio segment subsequences comprising a third subsequence of audio segments and a fourth subsequence of audio segments; and audibly presenting the generated audio segment sequence at least in part by audibly presenting the first subsequence of audio segments, the second subsequence of audio segments, the third subsequence of audio segments and the fourth subsequence of audio segments.

4. The method of claim 1, wherein generating the first subsequence of audio segments comprises selecting, in accordance with the first value indicating the amount of randomization, audio segments for the first subsequence from the at least a subset of the plurality of audio segments without replacement.

5. The method of claim 1, wherein the first order is different from the second order.

6. The method of claim 1, further comprising:

generating the plurality of audio segments at least in part by segmenting an audio recording.

7. A system for electronically generating music using a plurality of audio segments, the system comprising:

at least one computer hardware processor; and at least one non-transitory computer-readable storage medium storing processor-executable instructions that, when executed by the at least one computer hardware processor, cause the at least one computer hardware processor to perform:

obtaining at least a subset of the plurality of audio segments;

receiving first user input specifying a first value indicating an amount of randomization;

generating, using the at least a subset of the plurality of audio segments and the first value indicating the amount of randomization, an audio segment sequence comprising a plurality of audio segment subsequences having a first subsequence of audio segments and a second subsequence of audio segments, the generating comprising:

generating the first subsequence of audio segments to include each of the at least a subset of the plurality of audio segments in a first order determined based on the first value; and generating the second subsequence of audio segments to include each of the at least a subset of the plurality of audio segments in a second order determined based on the first value, wherein the first value specifies a probability in accordance to which an audio segment in a particular subsequence of audio segments is to be selected uniformly at random from among those audio segments in the at least a subset of the plurality of audio segments that have not yet selected to be part of the particular subsequence of audio segments; and audibly presenting the generated audio segment sequence at least in part by audibly presenting the first subsequence of audio segments and the second subsequence of audio segments.

8. The system of claim 7, further comprising:

an apparatus having a plurality of selectable elements, each of the plurality of audio segments being associated with a selectable element in the plurality of selectable elements, w herein the obtaining comprises obtaining the subset of the plurality of segments associated with selectable elements selected by a user.

9. A system for electronically generating music using a plurality of audio segments, the system comprising:

at least one computer hardware processor; and at least one non-transitory computer-readable storage medium storing processor-executable instructions that, when executed by the at least one computer hardware processor, cause the at least one computer hardware processor to perform:

obtaining at least a subset of the plurality of audio segments;

receiving first user input specifying a first value indicating an amount of randomization;

receiving second user input specifying a second value indicating a second amount of randomization, different from the first amount of randomization, to be employed in generating music using the at least a subset of the plurality of audio segments; and generating, using the at least a subset of the plurality of audio segments and the first value indicating the amount of randomization, an audio segment sequence comprising a plurality of audio segment subsequences having a first subsequence of audio segments and a second subsequence of audio segments, the generating comprising:

generating the first subsequence of audio segments to include each of the at least a subset of the plurality of audio segments in a first order determined based on the first value;

generating the second subsequence of audio segments to include each of the at least a subset of the plurality of audio segments in a second order determined based on the first value; and generating, using the at least a subset of the plurality of audio segments and the second value, an audio segment sequence comprising a plurality of audio segment subsequences comprising a third subsequence of audio segments and a fourth subsequence of audio segments; and audibly presenting the generated audio segment sequence at least in part by audibly presenting the first subsequence of audio segments, the second subsequence of audio segments, the third subsequence of audio segments and the fourth subsequence of audio segments.

10. The system of claim 7, wherein generating the first subsequence of audio segments comprises selecting, in accordance with the first value indicating the amount of randomization, audio segments for the first subsequence from the at least a subset of the plurality of audio segments without replacement.

11. The system of claim 7, wherein the first order is different from the second order.

12. At least one non-transitory computer-readable storage medium storing processor-executable instructions that, when executed by at least one computer hardware processor, cause the at least one computer hardware processor to perform a method for generating music using a plurality of audio segments, the method comprising:

obtaining at least a subset of the plurality of audio segments;

receiving first user input specifying a first value indicating an amount of randomization;

generating, using the at least a subset of the plurality of audio segments and the first value indicating the amount of randomization, an audio segment sequence comprising a plurality of audio segment subsequences having a first subsequence of audio segments and a second subsequence of audio segments, the generating comprising:

generating the first subsequence of audio segments to include each of the at least a subset of the plurality of audio segments in a first order determined based on the first value; and generating the second subsequence of audio segments to include each of the at least a subset of the plurality of audio segments in a second order determined based on the first value, wherein the first value specifies a probability in accordance to which an audio segment in a particular subsequence of audio segments is to be selected uniformly at random from among those audio segments in the at least a subset of the plurality of audio segments that have not yet selected to be part of the particular subsequence of audio segments; and audibly presenting the generated audio segment sequence at least in part by audibly presenting the first subsequence of audio segments and the second subsequence of audio segments.

13. The at least one non-transitory computer-readable storage medium of claim 12, wherein generating the first subsequence of audio segments comprises selecting, in accordance with the first value indicating the amount of randomization, audio segments for the first subsequence from the at least a subset of the plurality of audio segments without replacement.

14. At least one non-transitory computer-readable storage medium storing processor-executable instructions that, when executed by at least one computer hardware processor, cause the at least one computer hardware processor to perform a method for generating music using a plurality of audio segments, the method comprising:

obtaining at least a subset of the plurality of audio segments;

receiving first user input specifying a first value indicating an amount of randomization;

receiving second user input specifying a second value indicating a second amount of randomization, different from the first amount of randomization, to be employed in generating music using the at least a subset of the plurality of audio segments; and generating, using the at least a subset of the plurality of audio segments and the first value indicating the amount of randomization, an audio segment sequence comprising a plurality of audio segment subsequences having a first subsequence of audio segments and a second subsequence of audio segments, the generating comprising:

generating the first subsequence of audio segments to include each of the at least a subset of the plurality of audio segments in a first order determined based on the first value;

generating the second subsequence of audio segments to include each of the at least a subset of the plurality of audio segments in a second order determined based on the first value; and generating, using the at least a subset of the plurality of audio segments and the second value, an audio segment sequence comprising a plurality of audio segment subsequences comprising a third subsequence of audio segments and a fourth subsequence of audio segments; and audibly presenting the generated audio segment sequence at least in part by audibly presenting the first subsequence of audio segments, the second subsequence of audio segments, the third subsequence of audio segments and the fourth subsequence of audio segments.

* * * * *